US007642700B2

(12) United States Patent
Seki

(10) Patent No.: US 7,642,700 B2
(45) Date of Patent: Jan. 5, 2010

(54) FLAT-PANEL TYPE DISPLAY AND SPACER

(75) Inventor: Atsushi Seki, Kanagawa (JP)

(73) Assignee: Sony Corporation, Tokyo (JP)

( * ) Notice: Subject to any disclaimer, the term of this patent is extended or adjusted under 35 U.S.C. 154(b) by 423 days.

(21) Appl. No.: 11/797,696

(22) Filed: May 7, 2007

(65) Prior Publication Data

US 2007/0267953 A1 Nov. 22, 2007

(30) Foreign Application Priority Data

May 17, 2006 (JP) ..... 2006-137398

(51) Int. Cl.
*H01J 1/88* (2006.01)
*H01J 19/42* (2006.01)
*H01J 63/04* (2006.01)

(52) U.S. Cl. ..... 313/292; 313/495; 313/238

(58) Field of Classification Search ..... 313/292, 313/495
See application file for complete search history.

(56) References Cited

U.S. PATENT DOCUMENTS

2005/0062401 A1* 3/2005 Shimizu ..... 313/495

* cited by examiner

*Primary Examiner*—Joseph L Williams
*Assistant Examiner*—Thomas S Gresock
(74) *Attorney, Agent, or Firm*—Rader, Fishman & Grauer PLLC

(57) ABSTRACT

A flat-panel type display is provided, in which a marginal portion of a cathode panel provided with a plurality of electron emission regions and a marginal portion of an anode panel provided with luminescent layers and an anode are bonded to each other, spacers are disposed between the cathode panel and the anode panel, and a space sandwiched between the cathode panel and the anode panel is maintained under vacuum. The spacer includes a substrate of spacer and an antistatic coating disposed on the side surface of the spacer material, wherein the antistatic coating is formed from germanium nitride containing no transition metal, the thickness of the antistatic coating is within the range of 2 nm to 20 nm, and the volume resistivity of the substrate of spacer is within the range of $5\times10^6$ Ω·m to $2\times10^8$ Ω·m.

4 Claims, 8 Drawing Sheets

FLAT-PANEL TYPE DISPLAY AND SPACER

CROSS REFERENCES TO RELATED APPLICATIONS

The present invention contains subject matter related to Japanese Patent Application JP 2006-137398 filed in the Japanese Patent Office on May 17, 2006, the entire contents of which are incorporated herein by reference.

BACKGROUND OF THE INVENTION

1. Field of the Invention

The present invention relates to a spacer to be used in a flat-panel type display and a flat-panel type display incorporated with the spacer.

2. Description of the Related Art

Various flat-panel type displays have been researched as image displays alternative to the cathode ray tube (CRT). Examples of such flat-panel type displays may include a liquid crystal display (LCD), an electroluminescent display (ELD), and a plasma display panel (PDP). Furthermore, a flat-panel type display incorporated with an electron emission element is under development. Cold-cathode field electron emission elements, metal/insulating film/metal type elements (may be referred to as MIM elements) and surface-conduction type electron emission elements are known as electron emission elements. The flat-panel type displays incorporated with electron emission elements including these cold-cathode electron sources have attracted attention from the view point of high resolution, high-brightness color display and low power consumption.

In general, a cold-cathode field electron emission display (hereafter may be abbreviated as a display) serving as a flat-panel type display incorporated with a cold-cathode field electron emission element has a configuration in which a cathode panel and an anode panel are opposed to each other with a space maintained under vacuum therebetween, wherein the cathode panel has an electron emission region corresponding to each of subpixels arrayed in a two-dimensional matrix, and the anode panel has a luminescent layer that emits light through excitation due to collision with electrons emitted from the electron emission region. In general, at least one cold-cathode field electron emission element (hereafter may be abbreviated as a field emission element) is disposed in the electron emission region. Examples of electron emission elements may include a Spindt type, a flat type, an edge type, and a planar type.

FIG. 5 is a conceptual partial end view of an example of a display having a Spindt type field emission element. FIG. 6 is a schematic perspective exploded view of a part of a cathode panel CP and an anode panel AP when the cathode panel CP and the anode panel AP are disassembled. The Spindt type field emission element constituting this display is composed of a cathode 11 disposed on a support 10, an insulating layer 12 disposed on the support 10 and the cathode 11, a gate electrode 13 disposed on the insulating layer 12, openings 14 disposed in the gate electrode 13 and the insulating layer 12 (first openings 14A disposed in the gate electrode 13 and second openings 14B disposed in the insulating layer 12), and conical electron emission portions 15 disposed on the cathode 11 positioned at the bottoms of the openings 14.

In this display, the cathode 11 is in the shape of a band extending in a first direction (the Y direction shown in FIG. 5 and FIG. 6), and the gate electrode 13 is in the shape of a band extending in a second direction (the X direction shown in FIG. 5 and FIG. 6) different from the first direction. In general, each of the cathode 11 and the gate electrode 13 is formed into the shape of a band in such a way that the directions of the projected images of the two electrodes 11 and 13 become orthogonal to each other. The region where the band-shaped cathode 11 and the band-shaped gate electrode 13 overlap each other is an electron emission region EA corresponding to the region of one subpixel. Such electron emission regions EA are usually arrayed in a two-dimensional matrix in the effective region (the region corresponding to the display region of the display) of the cathode panel CP.

On the other hand, the anode panel AP has a structure in which luminescent layers 22 (specifically, red-emitting luminescent layers 22R, green-emitting luminescent layers 22G, and blue-emitting luminescent layers 22B) in a predetermined pattern are disposed on a substrate 20, and the luminescent layers 22 are covered with an anode 24. Spaces between these luminescent layers 22 are filled with light absorbing layers (black matrix) 23 formed from a light absorbing material, e.g., carbon, and thereby, an occurrence of color blurring of a displayed image or an occurrence of optical crosstalk may be prevented. In the drawings, reference numeral 21 denotes a partition wall, reference numeral 40 denotes, for example, a tabular spacer, reference numeral 25 denotes a spacer holding portion, reference numeral 26 denotes a bonding component formed from a bonding material, e.g., frit glass, reference numeral 16 denotes an interlayer insulating layer, and reference numeral 17 denotes a focusing electrode. In FIG. 6, the partition wall, the spacer, the spacer holding portion, the focusing electrode, and the interlayer insulating layer are omitted.

The anode 24 has a function as a reflective film for reflecting the light emitted from the luminescent layer 22 and, furthermore, a function of preventing charging of the luminescent layer 22. The partition wall 21 has a function of preventing an occurrence of so-called optical crosstalk (color blurring) due to collision of electrons recoiling from the luminescent layer 22 or secondary electrons emitted from the luminescent layer 22 (hereafter these electrons are collectively referred to as backscattered electrons) with the other luminescent layers 22.

Each subpixel is composed of an electron emission region EA on the cathode panel side and a luminescent layer 22 on the anode panel side facing a group of these field emission elements. In the display for performing color display, each pixel is composed of a set of one red-emitting luminescent layer, one green-emitting luminescent layer, and one blue-emitting luminescent layer. The above-described pixels of the order of a few hundreds of thousands to a few millions, for example, are arrayed in the effective region.

The anode panel AP and the cathode panel CP are arranged in such a way that the electron emission region EA and the luminescent layer 22 are opposed to each other, the marginal portions are bonded with the bonding component 26 therebetween, and evacuation is performed, followed by sealing, so that a display is produced. The space surrounded by the anode panel AP, the cathode panel CP, and the bonding component 26 is under high vacuum (for example, $1\times10^{-3}$ Pa or less).

Therefore, the display may be damaged by atmospheric pressure unless the spacers 40 are disposed between the anode panel AP and the cathode panel CP. The spacer 40 is composed of a substrate of spacer 40A and an antistatic coating 40B disposed on the side surface portion of the substrate of spacer 40A. These will be described later.

A relatively negative voltage is applied to the cathode 11 from a cathode control circuit 31, a relatively positive voltage is applied to the gate electrode 13 from a gate electrode control circuit 32, a relatively negative voltage (for example, 0 volts) is applied to the focusing electrode 17 from a focusing electrode control circuit (not shown in the drawing), and a positive voltage further higher than the voltage of the gate electrode 13 is applied to the anode 24 from an anode control circuit 33. In the case where display is performed in the above-described display, for example, a scanning signal is input into the cathode 11 from the cathode control circuit 31, and a video signal is input into the gate electrode 13 from the gate electrode control circuit 32. Alternatively, a video signal is input into the cathode 11 from the cathode control circuit 31, and a scanning signal is input into the gate electrode 13 from the gate electrode control circuit 32. Electrons are emitted from the electron emission portion 15 on the basis of the quantum tunnel effect by an electric field generated when a voltage is applied between the cathode 11 and the gate electrode 13, the electrons are attracted to the anode 24 and pass through the anode 24, so as to collide with the luminescent layer 22. As a result, the luminescent layer 22 is excited and emits light, so that a desired image is obtained. That is, the operation of this cold-cathode field electron emission display is basically controlled by the voltage applied to the gate electrode 13 and the voltage applied to the cathode 11.

The substrate of spacer 40A constituting the spacer 40 is formed from a rigid material, e.g., glass or ceramic. The two ends of the spacer 40 are in contact with the anode 24 and the focusing electrode 17, respectively. Consequently, a potential difference (voltage) between the voltage applied to the anode 24 and the voltage applied to the focusing electrode 17 is applied between the two ends of the spacer 40. The cathode panel side of the spacer may be in contact with another electrode, e.g., the gate electrode, depending on the type of the display. In this case, a potential difference (voltage) between the voltage applied to the anode and the voltage applied to the gate electrode is applied between the two ends of the spacer. Therefore, it is desired that the spacer 40 has basically high resistance, in order that an excessive current does not pass the spacer 40.

FIG. 7A and FIG. 7B schematically show the orbits of electron beams in a pixel positioned in the vicinity of the spacer 40. In FIG. 7A and FIG. 7B, the partition wall, the spacer holding portion, and the interlayer insulating layer are omitted. As shown in FIG. 7A, electrons emitted from the electron emission portion 15 head for the luminescent layer 22. However, when electrons are emitted from the electron emission portion 15 in the vicinity of the spacer 40, a part of electrons may collide with the side surface portion of the spacer 40. Furthermore, as shown in FIG. 7B, a part of electrons which have passed through the anode 24 of the anode panel AP and collided with the luminescent layer 22 may be backscattered at the luminescent layer 22, and a part of the backscattered electrons may collide with the side surface portion of the spacer 40. When the electrons collide with the spacer 40, secondary electrons are emitted from the surface thereof. In the case where the amount of electrons which collide with the spacer 40 is different from the amount of secondary electrons emitted from the spacer 40, the spacer 40 is charged and exerts an influence on the orbits of electrons and, thereby, changes in brightness of pixels along the spacer 40 occur. Therefore, an antistatic coating 40B formed from a material having a secondary electron emission coefficient close to 1 is disposed on the side surface portion of the substrate of spacer 40A. Various materials, e.g., graphite and other semimetals, oxides, borides, carbides, sulfides, and nitrides, have been known as the material having a secondary electron emission coefficient close to 1. For example, nitrides of transition elements (transition metals) and germanium nitride are disclosed as the nitride in Japanese Unexamined Patent Application Publication No. 2000-192017.

If the spacer 40 is a complete insulating material as a whole, the electrical charge of the side surface portion of the spacer 40 may not be passed to the anode panel AP side or the cathode panel CP side and, thereby, changes in brightness of pixels along the spacer 40 occur. Consequently, the spacer 40 is required to have high resistance in order that an excessive current due to a potential difference between the voltage applied to the anode and the voltage applied to the gate electrode does not pass and the electrical charge of the side surface portion of the spacer 40 is passed to the anode panel AP side or the cathode panel CP side without a hitch. In the case where the substrate of spacer 40A is formed from an insulating material, the antistatic coating 40B is required to have some extent of electrical conductivity. The germanium nitride is an insulating material and the transition elements conduct electricity well. The above-described Japanese Unexamined Patent Application Publication No. 2000-192017 discloses that the volume resistivity of a film formed from germanium nitride is adjusted by adding a transition element or a nitride of a transition element.

SUMMARY OF THE INVENTION

In the case where the antistatic coating 40B formed from germanium nitride, e.g., $Ge_3N_4$, containing a transition element or a nitride of a transition element is disposed on the side surface portion of the substrate of spacer 40A, the electrical resistance of the portion, which has collided with electrons, of the antistatic coating may be varied. As described above, the potential difference (voltage) between the voltage applied to the anode and the voltage applied to the gate electrode is applied between the two ends of the spacer 40. Therefore, if the electrical resistance of the portion, which have collided with electrons, of the antistatic coating 40B is varied, the electric field in the vicinity of the spacer 40 is varied and, thereby, the orbits of electrons are curved (refer to FIG. 8). Consequently, the brightness characteristics of pixels in the vicinity of the spacer 40 of the display are also varied.

Usually, variations in the electrical resistance of the antistatic coating 40B increase in accordance with the operation time of the display. Therefore, the degree of the above-described curving of the orbit of electron is increased in accordance with the operation time of the display. Accompanying this, the brightness characteristics of pixels in the vicinity of the spacer 40 of the display change over time. On the other hand, with respect to pixels distant from the spacer 40, the above-described phenomenon does not occur. Consequently, in the displayed image of the display, the brightness of pixels along the spacer 40 vary relatively and, thereby, the uniformity of the displayed image deteriorates.

Accordingly, it is desirable to provide a flat-panel type display capable of reducing relative changes in brightness of pixels along a spacer provided with an antistatic coating formed from germanium nitride and a spacer to be used in a flat-panel type display.

According to an embodiment of the present invention, a flat-panel type display is provided, in which a marginal portion of a cathode panel provided with a plurality of electron emission regions and a marginal portion of an anode panel provided with luminescent layers and an anode are bonded to each other, spacers are disposed between the cathode panel and the anode panel, and a space sandwiched between the cathode panel and the anode panel is maintained under vacuum, the spacer being composed of (a) a substrate of spacer and (b) an antistatic coating disposed on the side surface portion of the spacer material, wherein (A) the antistatic coating is formed from germanium nitride containing no transition metal, (B) the thickness of the antistatic coating is within the range of 2 nm to 20 nm, and (C) the volume resistivity of the substrate of spacer is within the range of $5\times10^6$ Ω·m to $2\times10^8$ Ω·m.

According to an embodiment of the present invention, a spacer to be used in a flat-panel type display, in which a marginal portion of a cathode panel provided with a plurality of electron emission regions and an anode panel provided with luminescent layers and an anode are bonded to each other, and a space sandwiched between the cathode panel and the anode panel is maintained under vacuum, is provided, the spacers being disposed between the cathode panel and the anode panel and composed of (a) a substrate of spacer and (b) an antistatic coating disposed on the side surface portion of the substrate of spacer, wherein (A) the antistatic coating is formed from germanium nitride containing no transition metal, (B) the thickness of the antistatic coating is within the range of 2 nm to 20 nm, and (C) the volume resistivity of the substrate of spacer is within the range of $5\times10^6$ Ω·m to $2\times10^8$ Ω·m.

The inventor of the present invention noted that with respect to an antistatic coating formed from germanium nitride, e.g., $Ge_3N_4$, containing a transition element or a nitride of a transition element, the degree of variation of the electrical resistance was increased by the transition element in the antistatic coating. It was ascertained by experiments that as the amount of addition of the transition element to the antistatic coating was increased, oxidation or reduction of germanium in the antistatic coating was facilitated, and the electric resistance was varied. However, with respect to the antistatic coating formed from germanium nitride containing no transition element, the volume resistivity of the antistatic coating is increased. Consequently, it is required that the electrical charge of the antistatic coating surface is passed to the anode panel AP side or the cathode panel CP side through the substrate of spacer without a hitch. If the thickness of the antistatic coating is less than 2 nm, it is difficult to form a continuous antistatic coating on the substrate of spacer, and the function of the antistatic coating may not be exerted satisfactorily. On the other hand, if the thickness of the antistatic coating is 20 nm or less, the electric charge due to charging of the antistatic coating surface may reach the substrate of spacer. Put another way, the electrons due to charging repeat collision with the constituent elements of the antistatic coating and scattering, so as to reach the substrate of spacer from the antistatic coating surface. Here, the antistatic coating is specified to be formed from germanium nitride containing no transition element, and the thickness of the antistatic coating is specified to be within the range of 2 nm to 20 nm. Then, the volume resistivity of the substrate of spacer is specified to be within the range of $5\times10^6$ Ω·m to $2\times10^8$ Ω·m, so that the electrical charge due to charging may be passed to the anode panel AP side or the cathode panel CP side without a hitch. Since the power consumption based on the current passing the substrate of spacer is increased as the volume resistivity of the substrate of spacer is decreased, a higher volume resistivity is desirable from the view point of the reduction of power consumption. On the other hand, since it is recognized that there is a trend toward faster changes over time of the orbits of electrons passing in the vicinity of the spacer as the volume resistivity of the substrate of spacer is increased, a lower volume resistivity is desirable from the view point of the reduction of changes over time. From these points of view, it is desirable that the volume resistivity of the substrate of spacer is within the range of $1\times10^7$ Ω·m to $1\times10^8$ Ω·m. When the volume resistivity of the substrate of spacer is specified to be within the range of $5\times10^6$ Ω·m to $2\times10^8$ Ω·m, preferably within the range of $1\times10^7$ Ω·m to $1\times10^8$ Ω·m, the entire spacer is allowed to have high resistance in such a way that an excessive current does not pass even by a potential difference between the voltage applied to the anode and the voltage applied to the gate electrode and the electrical charge of the side surface portion of the spacer is passed to the anode panel side or the cathode panel side without a hitch. Since the antistatic coating is formed from germanium nitride containing no transition element, variations in the electric resistance due to collision of electrons may be reduced. The term "containing no transition element" refers to less than or equal to the detection limit in the measurement with Rutherford backscattering spectrometry (RBS) described later. The detection limit of the RBS is usually about 1 atomic percent, although depending on the type of transition element.

In the spacer constituting the flat-panel type display according to an embodiment of the present invention or the spacer according to an embodiment of the present invention (hereafter these may be collectively referred to as the spacer according to an embodiment of the present invention), the germanium nitride film constituting the antistatic coating may be formed by known methods, for example, evaporation methods, e.g., an electron beam evaporation method and a hot filament evaporation method; various physical vapor deposition methods (PVD methods), e.g., a sputtering method, an ion plating method, and a laser ablation method; and various chemical vapor deposition methods (CVD methods). Among them, it is preferable that the antistatic coating is formed by the sputtering method through the use of a target formed from germanium containing no transition element. The antistatic coating composed of germanium nitride containing no transition element may easily be formed by performing sputtering in nitrogen or in an atmosphere composed of nitrogen and an inert gas.

With respect to the spacer according to an embodiment of the present invention, the thickness and the composition of the antistatic coating may be measured by, for example, the Rutherford backscattering spectrometry (RBS). In general, a film formed on a mirror-finished surface can be exactly measured by the RBS, but a film formed on an uneven surface may not be exactly measured. Therefore, an inspection base material having a mirror-finished surface may be prepared, a film may be formed on the inspection base material under the same film formation condition as that of the antistatic coating of the spacer, and the resulting film may be subjected to the measurement by the RBS. For example, a silicon wafer or glass provided with a film containing no transition metal or a high-purity alumina substrate having a mirror-finished surface may be used as the inspection base material. That is, in a step of forming the antistatic coating, antistatic coatings are formed in the state in which the substrate of spacer and the inspection base material are arranged side by side, and the antistatic coating formed on the inspection base material is measured. Consequently, the thickness and the composition of the antistatic coating may be exactly measured.

Hereafter, the flat-panel type display according to an embodiment of the present invention or the spacer according to an embodiment of the present invention may be simply referred to as an embodiment of the present invention.

In an embodiment of the present invention, examples of a rigid material constituting the substrate of spacer may include ceramic and glass. Examples of ceramic materials may include aluminum silicate compounds, e.g., mullite, aluminum oxide, e.g., alumina, barium titanate, lead zirconate titanate, zirconia (zirconium oxide), cordierite, barium borosilicate, iron silicate, glass ceramic materials, and these materials including titanium oxide, chromium oxide, magnesium oxide, iron oxide, vanadium oxide, or nickel oxide. The materials described in, for example, PCT Japanese Translation Patent Publication No. 2003-524280 may also be used. Examples of glass materials may include high strain point glass, low alkali glass, no-alkali glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$).

In an embodiment of the present invention, in the case where the substrate of spacer is composed of a ceramic material, the ceramic material constituting the substrate of spacer may be produced by, for example, (a) preparing a green sheet slurry in which the dispersoid is a ceramic powder and a binder is added, (b) producing a green sheet from the resulting green sheet slurry, and (c) firing the green sheet.

The ceramic material constituting the substrate of spacer is formed by sintering the ceramic powder in the green sheet slurry. Examples of materials constituting the ceramic powder serving as the dispersoid in the green sheet slurry may include the same materials as those exemplified in the description of the above-described substrate of spacer. If necessary, an electrical conductivity-imparting material may be added as a dispersoid to the slurry. The electrical conductivity-imparting material may not exhibit electrical conductivity in the slurry. The chemical composition of the electrical conductivity-imparting material may be varied by the firing of the green sheet. Alternatively, the chemical composition thereof may not be varied by the firing. Specifically, when the green sheet is fired, the electrical conductivity-imparting material in the green sheet is also fired, and the fired electrical conductivity-imparting material is required to exhibit the electrical conductivity. Examples of electrical conductivity-imparting materials serving as dispersoid in the green sheet slurry may include noble metals, e.g., gold and platinum; metal oxides, e.g., molybdenum oxide, niobium oxide, tungsten oxide, and nickel oxide; metal carbides, e.g., titanium carbide, tungsten carbide, and nickel carbide; and metal salts, e.g., ammonium molybdate. Furthermore, mixtures thereof may be used. Examples of materials constituting the binder to be added to the green sheet slurry may include organic binder materials (for example, acrylic emulsion, polyvinyl alcohol (PVA), polyethylene glycol) or inorganic binder material (for example, water glass).

The flat-panel type display according to an embodiment of the present invention including the above-described preferable configurations and forms may be used as a cold-cathode field electron emission display having an electron emission region composed of a plurality of cold-cathode field electron emission elements (hereafter referred to as field emission elements), or be used as a flat-panel type display having an electron emission region composed of metal/insulating film/metal type elements (may be referred to as MIM elements) or a flat-panel type display having an electron emission region composed of surface-conduction type electron emission elements.

In the case where the flat-panel type display is used as the cold-cathode field electron emission display, the electron emission region for emitting electrons is provided with a plurality of field emission elements, and each field emission element is composed of (a) a band shaped cathode which is disposed on a support and which is extended in a first direction, (b) an insulating layer disposed on the cathode and the support, (c) a band shaped gate electrode which is disposed on the insulating layer and which is extended in a second direction different from the first direction, (d) an opening which is disposed in the portions of the gate electrode and the insulating layer positioned at an overlapping portion where the cathode and the gate electrode overlap each other and in which the cathode is exposed at the bottom, and (e) electron emission portions disposed on the cathode exposed at the bottom of the opening.

The type of the field emission element is not specifically limited, and examples thereof may include a Spindt type field emission element (a field emission element in which a conical electron emission portion is disposed on a cathode positioned at the bottom of an opening) and a flat type field emission element (a field emission element in which a nearly planar electron emission portion is disposed on a cathode positioned at the bottom of an opening).

In the cathode panel, it is preferable that the projected image of the cathode and the projected image of the gate electrode are orthogonal to each other, that is, the first direction and the second direction are orthogonal to each other from the view point of simplification of the structure of the cold-cathode field electron emission display. The overlapping portion where the cathode and the gate electrode overlap each other corresponds to an electron emission region, and the electron emission regions are arrayed in a two-dimensional matrix in the effective region of the cathode panel.

In the cold-cathode field electron emission display, an intense electric field generated by voltages applied to the cathode and the gate electrode is applied to the electron emission portion. As a result, electrons are emitted from the electron emission portion on the basis of the quantum tunnel effect. The electrons are attracted to the anode panel due to the anode disposed on the anode panel, and collide with the luminescent layer. As a result of the collision of the electrons with the luminescent layer, the luminescent layer emits light, and it is possible to recognize as an image.

In the cold-cathode field electron emission display, the cathode is connected to a cathode control circuit, the gate electrode is connected to a gate electrode control circuit, and the anode is connected to an anode control circuit. These control circuits may be composed of known circuits. In an actual operation, the voltage (anode voltage) $V_A$ applied from the anode control circuit to the anode is usually constant, and may be set at 5 kilovolts to 15 kilovolts, for example. Alternatively, when the distance between the anode panel and the cathode panel is assumed to be $d_0$ (where $0.5\ mm \leqq d_0 \leqq 10\ mm$), it is desirable that the value of $V_A/d_0$ (unit: kilovolt/mm) satisfies 0.5 or more, and 20 or less, preferably 1 or more, and 10 or less, and more preferably 4 or more, and 8 or less. In the actual operation of the cold-cathode field electron emission display, with respect to the voltage $V_C$ applied to the cathode and the voltage $V_G$ applied to the gate electrode, a voltage modulation system may be adopted as the gradation control system.

In general, the field emission element may be produced by the method including the following steps of:

(1) forming a cathode on a support, (2) forming an insulating layer all over the surface (on the support and the cathode), (3) forming a gate electrode on the insulating layer, (4) forming an opening in the portions of the gate electrode and the insulating layer in a overlapping region where the cathode and the gate electrode overlap each other, and exposing the cathode at the bottom of the opening, and (5) forming an electron emission portion on the cathode positioned at the bottom of the opening.

Alternatively, the field emission element may also be produced by the method including the following steps of:

(1) forming a cathode on a support, (2) forming an electron emission portion on the cathode, (3) forming an insulating layer all over the surface (on the support and the electron emission portion or on the support, cathode, and the electron emission portion), (4) forming a gate electrode on the insulating layer, and (5) forming an opening in the portions of the gate electrode and the insulating layer in a overlapping region of the cathode and the gate electrode, and exposing the electron emission portion at the bottom of the opening.

The field emission element may be provided with a focusing electrode. That is, for example, a field emission element, in which an interlayer insulating layer is further disposed on the gate electrode and the insulating layer, and a focusing electrode is disposed on the interlayer insulating layer, may be produced. Alternatively, a field emission element, in which a focusing electrode is disposed above the gate electrode, may also be produced. Here, the focusing electrode is an electrode for converging the orbits of emitted electrons emitted toward the anode from the opening, so as to make it possible to improve the brightness and prevent an occurrence of the optical crosstalk between adjacent pixels. The focusing electrode is particularly effective in a so-called high-voltage type cold-cathode field electron emission display in which the potential difference between the anode and the cathode is of the order of a few kilovolts or more, and the distance between the anode and the cathode is relatively large. A relatively negative voltage (for example, 0 volts) is applied to the focusing electrode from the focusing electrode control circuit. It is not necessarily that the focusing electrodes are formed separately in such a way as to surrounding individual electron emission portions or electron emission regions disposed in the overlapping region where the cathode and the gate electrode overlap each other. For example, the focusing electrode may be extended along a predetermined array direction of the electron emission portions or the electron emission regions, or all the electron emission portions or the electron emission regions may be surrounded by one focusing electrode (that is, the structure of the focusing electrode may be a thin single sheet covering the entire effective region which is a central display region and which performs a practical function as the cold-cathode field electron emission display). In this manner, a common converging effect may be exerted on a plurality of electron emission portions or electron emission regions.

With respect to the Spindt type field emission element, examples of materials constituting the electron emission portion include at least one material selected from the group consisting of molybdenum, molybdenum alloys, tungsten, tungsten alloys, titanium, titanium alloys, niobium, niobium alloys, tantalum, tantalum alloys, chromium, chromium alloys, and impurity-containing silicon (polysilicon and amorphous silicon). The electron emission portion of the Spindt type field emission element may be formed by various PVD methods and various CVD methods, such as a sputtering method and a vacuum evaporation method.

With respect to the flat type field emission element, it is preferable that the material constituting the electron emission portion is a material having a work function $\Phi$ smaller than that of the material constituting the cathode. The material to be selected may be determined on the basis of the work function of the material constituting the cathode, the potential difference between the gate electrode and the cathode, the required value of emitted electron current density, and the like. Alternatively, the material constituting the electron emission portion may be selected appropriately from materials exhibiting a secondary electron gain $\delta$ larger than the secondary electron gain $\delta$ of the electrically conductive material constituting the cathode. With respect to the flat type field emission element, examples of particularly preferable constituent materials of the electron emission portion may include carbon, more specifically, amorphous diamond, graphite, and carbon•nanotube structure (carbon-nanotube and/or graphite•nanofiber), ZnO whisker, MgO whisker, $SnO_2$ whisker, MnO whisker, $Y_2O_3$ whisker, NiO whisker, ITO whisker, $In_2O_3$ whisker, and $Al_2O_3$ whisker. The material constituting the electron emission portion may not have the electrical conductivity.

Examples of constituent materials of the cathode, the gate electrode, and the focusing electrode may include metals, e.g., aluminum (Al), tungsten (W), niobium (Nb), tantalum (Ta), molybdenum (Mo), chromium (Cr), copper (Cu), gold (Au), silver (Ag), titanium (Ti), nickel (Ni), cobalt (Co), zirconium (Zr), iron (Fe), platinum (Pt), and zinc (Zn); alloys (for example, MoW) or compounds (for example, nitrides, e.g., TiN, and silicide, e.g., $WSi_2$, $MoSi_2$, $TiSi_2$, and $TaSi_2$) containing these metal elements; semiconductors, e.g., silicon (Si); carbon thin films, e.g., diamond; and electrically conductive metal oxides, e.g., ITO (indium oxide-tin), indium oxide, and zinc oxide. Examples of methods for forming these electrodes may include evaporation methods, e.g., an electron beam evaporation method and a hot filament evaporation method; combinations of a sputtering method, a CVD method, or an ion plating method with an etching method; various printing methods, e.g., a screen printing method, an ink-jet printing method, and a metal mask printing method; plating methods (electroplating method and electroless nickel plating method); a lift off method; a laser abrasion method; and a sol-gel method. According to the various printing methods and plating methods, for example, a band-shaped cathode and a gate electrode may be directly formed.

For the constituent material of the insulating layer and the interlayer insulating layer, $SiO_2$ based materials, e.g., $SiO_2$, BPSG, PSG, BSG, AsSG, PbSG, SiON, SOG (spin-on-glass), low melting point glass, and glass paste; SiN based materials; and insulating resins, e.g., polyimide, may be used alone or in appropriate combination. Known processes, e.g., a CVD method, a coating method, a sputtering method, and various printing methods may be used for formation of the insulating layer and the interlayer insulating layer.

The two-dimensional shape (the shape of a cross section of the opening cut along a virtual plane parallel to the support surface) of the first opening (the opening disposed in the gate electrode) or the second opening (the opening disposed in the insulating layer) may be an arbitrary shape, e.g., a circle, an ellipse, a rectangle, a polygon, a rounded rectangle, a rounded polygon, or the like. The first opening may be formed by, for example, anisotropic etching, isotropic etching, or a combination of anisotropic etching and isotropic etching. Alternatively, the first opening may be directly formed depending on the method for forming the gate electrode. The second opening may also be formed by, for example, anisotropic etching, isotropic etching, or a combination of anisotropic etching and isotropic etching.

In the field emission element, although depending on the structure of the field emission element, one electron emission portion may be present in one opening, or a plurality of electron emission portions may be present in one opening. Alternatively, a plurality of first openings may be disposed in the gate electrode, one second opening communicating with the first openings may be disposed in the insulating layer, and at least one electron emission portion may be present in each second opening disposed in the insulating layer.

In the electron emission element, a resistor film may be disposed between the cathode and the electron emission portion. When the resistor film is disposed, stabilization of operation of the field emission element and uniformization of electron emission characteristics may be facilitated. Examples of materials constituting the resistor film may include carbon based materials, e.g., silicon carbide (SiC) and SiCN; semiconductor materials, e.g., SiN and amorphous silicon; and high-melting point metal oxides, e.g., ruthenium oxide ($RuO_2$) and tantalum oxide. Examples of methods for forming the resistor film may include a sputtering method, a CVD method, and various printing methods. In general, the electric resistance value per electron emission portion is $1\times10^6$ to $1\times10^{11}\Omega$, preferably is a few tens of gigaohms.

Examples of supports constituting the cathode panel or substrates constituting the anode panel may include a glass substrate, a glass substrate provided with an insulating film on the surface, a quartz substrate, a quartz substrate provided with an insulating film on the surface, and a semiconductor substrate provided with an insulating film on the surface. However, it is preferable to use a glass substrate or a glass substrate provided with an insulating film on the surface from the view point of reduction of the production cost. Examples of glass substrates may include high strain point glass, soda glass ($Na_2O.CaO.SiO_2$), borosilicate glass ($Na_2O.B_2O_3.SiO_2$), forsterite ($2MgO.SiO_2$), lead glass ($Na_2O.PbO.SiO_2$), and no-alkali glass.

In the flat-panel type display, examples of configurations of the anode and the luminescent layer may include (1) a configuration in which an anode is disposed on a substrate and a luminescent layer is disposed on the anode and (2) a configuration in which a luminescent layer is disposed on a substrate and an anode is disposed on the luminescent layer. In the configuration of the item (1), a so-called metal-backed film connected to the anode may be disposed on the luminescent layer. In the configuration of the item (2), a metal-backed film may be disposed on the anode.

The anode may be composed of one anode as a whole or a plurality of anode units. In the latter case, it is desirable that one anode unit and another anode unit are electrically connected to each other with an anode resistor layer. Examples of materials constituting the anode resistor layer may include carbon based materials, e.g., carbon, silicon carbide (SiC), and SiCN; SiN based materials; high-melting point metal oxides, e.g., ruthenium oxide ($RuO_2$), tantalum oxide, chromium oxide, and titanium oxide; semiconductor materials, e.g., amorphous silicon; and ITO. It is also possible to realize a stable desired sheet resistance value by the combination of a plurality of films, for example, carbon thin films having a low resistance value are laminated on a SiC resistance film. For example, the sheet resistance value of the anode resistance layer may be $1\times10^{-1}\Omega/\square$ to $1\times10^{10}\Omega/\square$, preferably be $1\times10^3\Omega/\square$ to $1\times10^8\Omega/\square$. The number of anode units (Q) may be 2 or more. For example, when the total number of lines of luminescent layers arrayed linearly is assumed to be q, Q=q or q=k·Q (where k is an integer of 2 or more, preferably $10\leqq k\leqq100$, more preferably $20\leqq k\leqq50$) may be satisfied. The value of q may be the number of groups of spacers arranged at a predetermined spacing plus one, the same number as the number of pixels or subpixels, or an integral submultiple of the number of pixels or subpixels. The size of each anode unit may be uniform regardless of the position of the anode unit, or be different depending on the position of the anode unit. An anode resistor layer may be disposed on one anode as a whole.

The anode (including the anode unit) may be formed by using an electrically conductive material layer. Examples of methods for forming the electrically conductive material layer may include evaporation methods, e.g., an electron beam evaporation method and a hot filament evaporation method; various PVD methods, e.g., a sputtering method, an ion plating method, and a laser abrasion method; various CVD methods; various printing methods; a lift off method; and a sol-gel method. That is, an electrically conductive material layer composed of an electrically conductive material may be formed, the resulting electrically conductive material layer may be patterned on the basis of the lithography technology and the etching technology, so as to form an anode. Alternatively, the anode may also be produced by forming an electrically conductive material through a mask or screen having a pattern of the anode on the basis of a PVD method or various printing methods. The anode resistor layer may also be formed by the same method. That is, the anode resistor layer may be formed from a resistor material, and the resulting anode resistor layer may be patterned on the basis of the lithography technology and the etching technology. Alternatively, the anode resistor layer may be produced by forming a resistor material through a mask or screen having a pattern of the anode resistor layer on the basis of a PVD method or various printing methods. For example, the average thickness (when a partition wall is disposed as described later, the average thickness of the anode on the top surface of the partition wall) of the anode on the substrate (or above the substrate) may be $3\times10^{-8}$ m (30 nm) to $5\times10^{-7}$ m (0.5 μm), preferably be $5\times10^{-8}$ m (50 nm) to $3\times10^{-7}$ m (0.3 μm).

Examples of constituent materials of the anode may include metals, e.g., molybdenum (Mo), aluminum (Al), chromium (Cr), tungsten (W), niobium (Nb), tantalum (Ta), gold (Au), silver (Ag), titanium (Ti), cobalt (Co), zirconium (Zr), iron (Fe), platinum (Pt), and zinc (Zn); alloys or compounds (for example, nitrides, e.g., TiN, and silicide, e.g., $WSi_2$, $MoSi_2$, $TiSi_2$, and $TaSi_2$) containing these metal elements; semiconductors, e.g., silicon (Si); carbon thin films, e.g., diamond; and electrically conductive metal oxides, e.g., ITO (indium oxide-tin), indium oxide, and zinc oxide. In the case where the anode resistor layer is formed, it is preferable that the anode is composed of an electrically conductive material which does not change the resistance value of the anode resistor layer. For example, in the case where the anode resistor layer is composed of silicon carbide (SiC), it is preferable that the anode is composed of molybdenum (Mo).

The luminescent layer may be composed of monochromatic luminescent particles, or be composed of primary-colors luminescent particles. The array form of the luminescent layers is a dot pattern. Specifically, in the case where the flat-panel type display performs color display, example of arrangement and array of the luminescent layers may include a delta array, a stripe array, a diagonal array, and a rectangle array. That is, one line of luminescent layers arrayed in a linear line may be composed of a line in which red-emitting luminescent layers constitute the entirety, a line in which green-emitting luminescent layers constitute the entirety, and a line in which blue-emitting luminescent layers constitute the entirety, or be composed of a line in which a red-emitting luminescent layer, a green-emitting luminescent layer, and a blue-emitting luminescent layer are arranged sequentially. Here, the luminescent layer is defined as a luminescent region which generates one bright spot in the flat-panel type display. One pixel is composed of a set of one red-emitting luminescent layer, one green-emitting luminescent layer, and one blue-emitting luminescent layer, and one subpixel is composed of one luminescent layer (one red-emitting luminescent layer, one green-emitting luminescent layer, or one blue-emitting luminescent layer). A gap between adjacent luminescent layers may be filled with a light absorption layer (black matrix) for the purpose of improvement of the contrast.

The luminescent layer may be formed by a method in which a light-emitting crystal grain composition prepared from light-emitting crystal grains is used, for example, a red photosensitive light-emitting crystal grain composition (red-emitting luminescent slurry) is applied all over the surface, followed by exposure and development, so as to form a red-emitting luminescent layer, a green photosensitive light-emitting crystal grain composition (green-emitting luminescent slurry) is applied all over the surface, followed by exposure and development, so as to form a green-emitting luminescent layer, and furthermore, a blue photosensitive light-emitting crystal grain composition (blue-emitting luminescent slurry) is applied all over the surface, followed by exposure and development, so as to form a blue-emitting luminescent layer. Alternatively, the red-emitting luminescent slurry, the green-emitting luminescent slurry, and the blue-emitting luminescent slurry may be applied sequentially, and individual luminescent slurries may be exposed and developed sequentially, so as to form individual luminescent layers, or individual luminescent layers may be formed by a screen printing method, an ink-jet printing method, a float coating method, a deposit coating method, a luminescent film transfer method, or the like. The average thickness of the luminescent layer on the substrate is not limited, but it is desirable that the thickness is 3 μm to 20 μm, and preferably is 5 μm to 10 μm. The luminescent material to be used for constituting the light-emitting crystal grains may be selected appropriately from previously known luminescent materials. For color display, it is preferable to combine luminescent materials in such a way that the color purity becomes close to the primary colors specified by NTSC, white balance is achieved when the primary colors are mixed, the persistence time is small, and the persistence times of the primary colors are nearly equalized.

Preferably, a light absorption layer for absorbing the light from the luminescent layer is disposed between adjacent luminescent layers or between the partition wall and the substrate from the view point of improvement of the contrast in the displayed image. Here, the light absorption layer functions as a so-called black matrix. Preferably, a material which absorbs 90% or more of the light from the luminescent layer is selected as the material constituting the light absorption layer. Examples of such materials may include carbon, metal thin films (for example, chromium, nickel, aluminum, molybdenum, and the like and alloys thereof), metal oxides (for example, chromium oxide), metal nitrides (for example, chromium nitride), heat-resistant organic resins, glass pastes, and glass pastes containing electrically conductive particles, e.g., black pigments or silver. Specific examples may include a photosensitive polyimide resin, chromium oxide, and a chromium oxide/chromium laminated film. In the chromium oxide/chromium laminated film, a chromium film is in contact with a substrate. The light absorption layer may be formed by a method, e.g., a combination of a vacuum evaporation method or a sputtering method with an etching method, a combination of a vacuum evaporation method, a sputtering method, or a spin coating method with a lift off method, various printing methods, and lithography technology, selected appropriately depending on the material to be used.

Preferably, a partition wall is disposed in order to prevent an occurrence of so-called optical crosstalk (color blurring) due to entrance of electrons recoiling from the luminescent layer or secondary electrons emitted from the luminescent layer into the other luminescent layers.

Examples of methods for forming the partition wall may include a screen printing method, a dry film method, a light exposure method, a casting method, and a sandblast formation method. Here, the screen printing method refers to a method in which an opening is disposed at a portion of a screen corresponding to the portion to be provided with a partition wall, a partition wall-forming material on the screen is passed through the opening by using a squeegee, a partition wall-forming material layer is formed on the substrate and, thereafter, the resulting partition wall-forming material layer is fired. The dry film method refers to a method in which a photosensitive film is laminated on a substrate, the photosensitive film in the section intended to be provided with a partition wall is removed by exposure and development, and the partition wall-forming material is filled in the opening resulting from the removal, followed by firing. The photosensitive film is burnt and removed by the firing, the partition wall-forming material filled in the opening is left so as to become the partition wall. The light exposure method refers to a method in which a photosensitive partition wall-forming material layer is formed on a substrate, and the resulting photosensitive partition wall-forming material layer is patterned by exposure and development, followed by firing (curing). The casting method (cast extrusion method) refers to a method in which a paste-like partition wall-forming material layer composed of an organic material or an inorganic material is extruded from a cast on a substrate so as to form a partition wall-forming material layer and, thereafter, the resulting partition wall-forming material layer is fired. The sandblast formation method refers to a method in which a partition wall-forming material layer is formed on a substrate by using, for example, a screen printing method, metal mask printing method, a roll coater, a doctor blade, or a nozzle discharge coater, followed by drying, a portion of the partition wall-forming material layer to serve as a partition wall is covered with a mask layer and, thereafter, an exposed portion of the partition wall-forming material layer is removed by the sandblast method. After the partition wall is formed, the partition wall may be polished so as to flatten the partition wall top surface.

The two-dimensional shape of the portion of the partition wall surrounding the luminescent layer (some type of opening region corresponding to an inside contour line of the projected image of the partition wall side surface) may be a rectangle, a circle, an ellipse, an oval figure, a triangle, a pentagon or a higher order of polygon, a rounded triangle, a rounded rectangle, a rounded polygon, or the like. These two-dimensional shapes (two-dimensional shape of opening region) are arranged in a two-dimensional matrix and, thereby, lattice shaped partition wall is formed. The arrangement of the two-dimensional matrix may be, for example, a double crossed type arrangement or a staggered arrangement.

Examples of the partition wall-forming materials include a photosensitive polyimide resin; lead glass colored black with a metal oxide, e.g., cobalt oxide; $SiO_2$; and low-melting point glass paste. A protective layer (composed of, for example, $SiO_2$, SiON, or AlN) for preventing release of gases from the partition wall due to collision of an electron beam with the partition wall may be formed on the surfaces (top surface and side surface) of the partition wall.

In the present invention, the spacer may be fixed by, for example, being sandwiched between a partition wall and another partition wall disposed on the anode panel, as described later. Alternatively, a spacer holding portion may be disposed on the anode panel and/or the cathode panel, and the spacer may be fixed by the spacer holding portion.

In the case where the cathode panel and the anode panel are bonded to each other with a bonding component, the entire bonding component may be composed of a bonding material, e.g., frit glass. Alternatively, the bonding component may be composed of a frame body which is in the shape of a rod or a frame and which is composed of a rigid material, e.g., glass or ceramic, a bonding material layer disposed on the surface on the cathode panel side of the frame body, and a bonding material layer disposed on the surface on the anode panel side of the frame body. The distance between the opposed cathode panel and the anode panel can be set at a longer distance by selecting appropriately the height of the frame body as compared with the distance when the entire bonding component is composed of the bonding material. In general, frit glass, e.g., $B_2O_3$—PbO based frit glass or $SiO_2$—$B_2O_3$—PbO based frit glass, is used as the material for constituting the bonding material or the bonding material layer. However, a so-called low-melting point metal material having a melting point of about 120° C. to 400° C. may be used. Examples of such low-melting point metal materials may include indium (In: melting point 157° C.); indium-gold based low-melting point alloys; tin (Sn) based high-temperature solder, e.g., $Sn_{80}Ag_{20}$ (melting point 220° C. to 370° C.) and $Sn_{95}Cu_5$ (melting point 227° C. to 370° C.) lead (Pb) based high-temperature solder, e.g., $Pb_{97.5}Ag_{2.5}$ (melting point 304° C.), $Pb_{94.5}Ag_{5.5}$ (melting point 304° C. to 365° C.), and $Pb_{97.5}Ag_{1.5}Sn_{1.0}$ (melting point 309° C.); zinc (Zn) based high-temperature solder, e.g., $Zn_{95}Al_5$ (melting point 380° C.); tin-lead based standard solder, e.g., $Sn_5Pb_{98}$ (melting point 300° C. to 314° C.) and $Sn_2Pb_{98}$ (melting point 316° C. to 322° C.); and a brazing material, e.g., $Au_{88}Ga_{12}$ (melting point 381° C.), where a numerical subscript represents atomic percent.

In the case where three components, the cathode panel, the anode panel, and the bonding component, are bonded together, the three components may be bonded simultaneously, or any one of the cathode panel and the anode panel may be bonded to the bonding component at a first stage, and the remaining one of the cathode panel and the anode panel may be bonded to the bonding component at a second stage. When the simultaneous bonding of the three components or the bonding at the second stage is performed in a high vacuum atmosphere, the space surrounded by the cathode panel, the anode panel, and the bonding component becomes under vacuum at the same time with the bonding. Alternatively, after the bonding of the three components are completed, the space surrounded by the cathode panel, the anode panel, and the bonding component may be evacuated so as to produce a vacuum. When evacuation is performed after the bonding, the pressure of the atmosphere during the bonding may be either atmospheric pressure or a reduced pressure. The gas constituting the atmosphere may be air, a nitrogen gas, or an inert gas containing a gas belong to zero group in the periodic table (for example, an Ar gas).

When the exhaust is performed, the gas may be exhausted through an exhaust tube connected to the cathode panel and/or the anode panel in advance. Typically, the exhaust tube is a glass tube or a hollow tube composed of a metal or an alloy having a low thermal expansion coefficient, for example, an iron (Fe) alloy containing 42 percent by weight of nickel (Ni) or an iron (Fe) alloy containing 42 percent by weight of nickel (Ni) and 6 percent by weight of chromium (Cr). The exhaust tube is bonded around a penetration portion disposed in an invalid region (a region like a frame surrounding the effective region that is a central display region for practically functioning as a flat-panel type display) of the cathode panel and/or the anode panel by using the above-described frit glass or low melting point metal material. After the space reaches a predetermined degree of vacuum, the exhaust tube is heat-sealed and cut or is sealed by press-bond. When the entire flat-panel type display is once heated and, subsequently, the temperature is decreased before sealing, favorably, the remaining gas may be released and the remaining gas may be removed to the outside of the space.

According to the spacer of an embodiment of the present invention, since the antistatic coating is formed from germanium nitride containing no transition element, variations in electrical resistance due to collision of electrons may be reduced. When the thickness of the antistatic coating is specified to be within the range of 2 nm to 20 nm and the volume resistivity of the substrate of spacer is specified to be within the range of $5\times10^6$ Ω·m to $2\times10^8$ Ω·m, the electrical charge due to charging may be passed to the anode panel side or the cathode panel side without a hitch. According to the flat-panel type display of an embodiment of the present invention, a flat-panel type display capable of reducing changes in brightness, which occur in pixels along a spacer, may be obtained.

DESCRIPTION OF THE PREFERRED EMBODIMENTS

The present invention will be described below on the basis of Example with reference to the drawings.

Example

Figure 1:
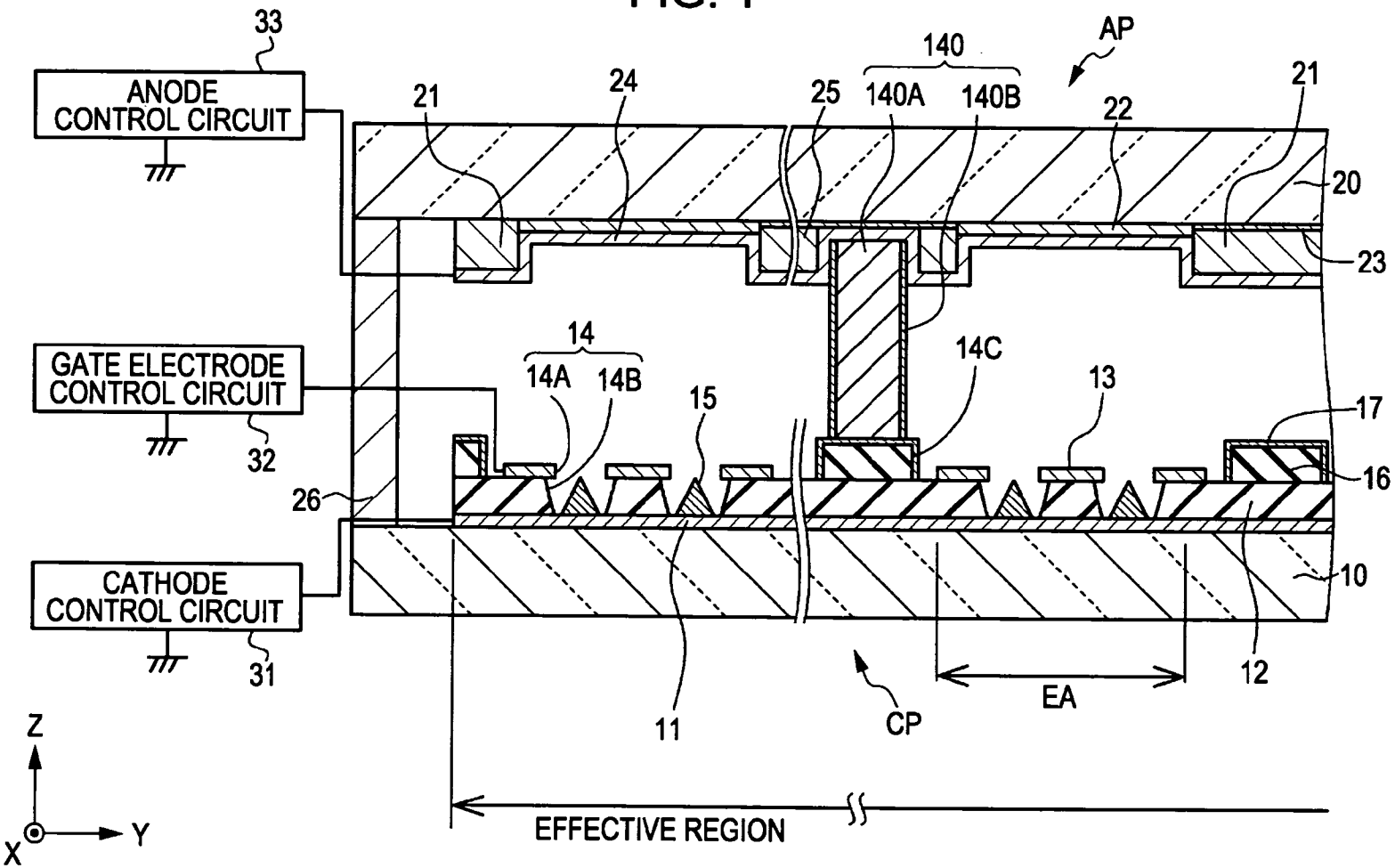
FIG. 1 is a conceptual partial end view of a flat-panel type display (cold-cathode field electron emission display) of Example.

Example is related to a flat-panel type display according to an embodiment of the present invention and a spacer according to an embodiment of the present invention. FIG. 1 is a conceptual partial end view of a flat-panel type display of Example. The flat-panel type display of Example is a cold-cathode field electron emission display (hereafter abbreviated as a display) similarly to the display described in Related Art.

Figure 6:
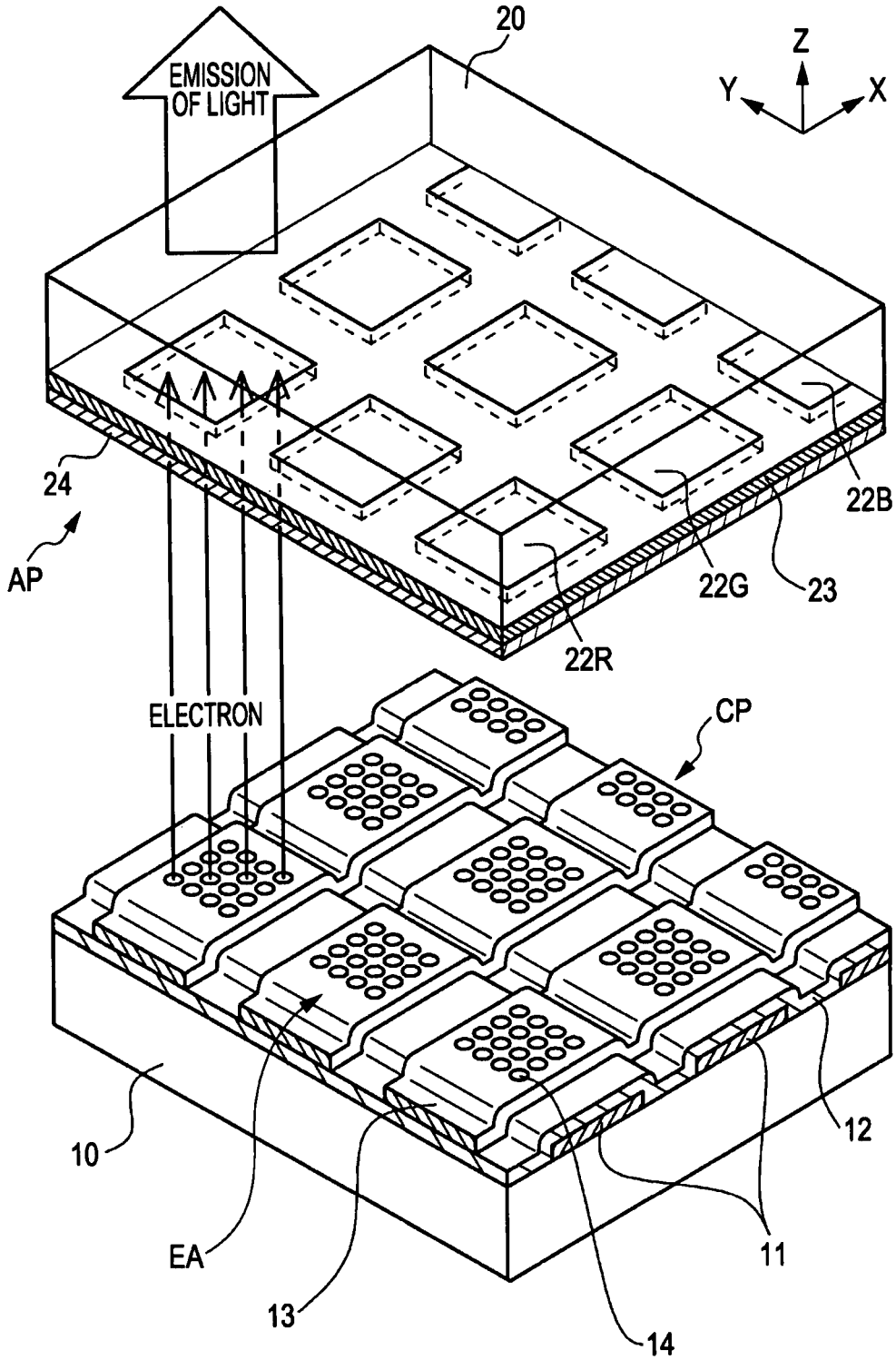
FIG. 6 is a schematic perspective exploded view of a part of a cathode panel and an anode panel when the cathode panel and the anode panel are disassembled.
Figure 7A:
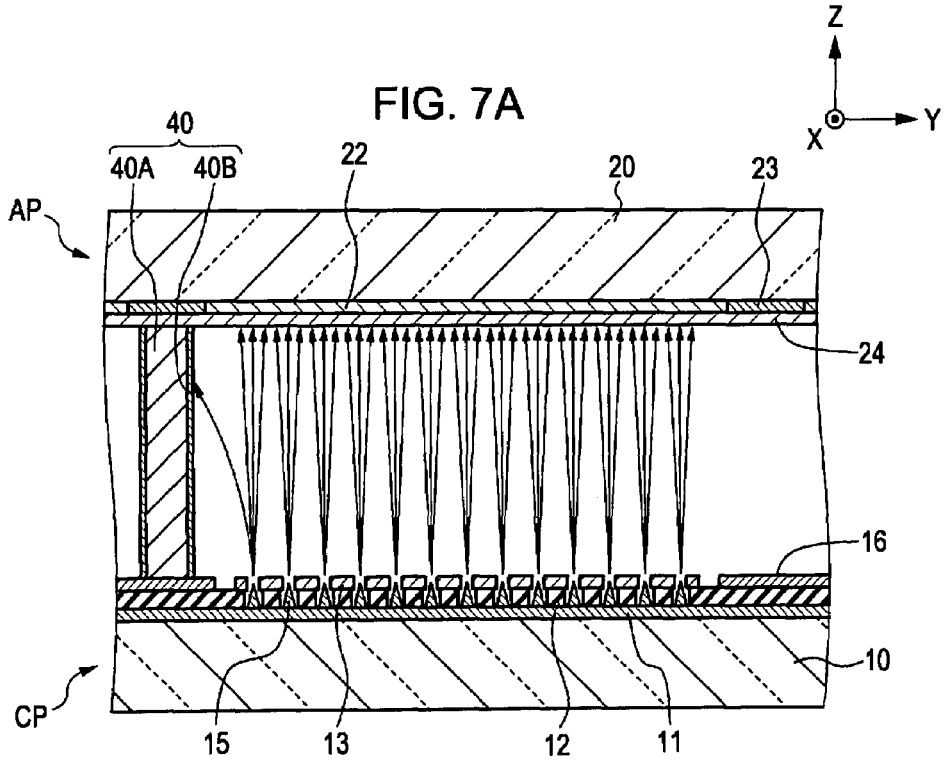
FIG. 7A and FIG. 7B schematically show the orbits of electron beams in a pixel positioned in the vicinity of the spacer.
Figure 7B:
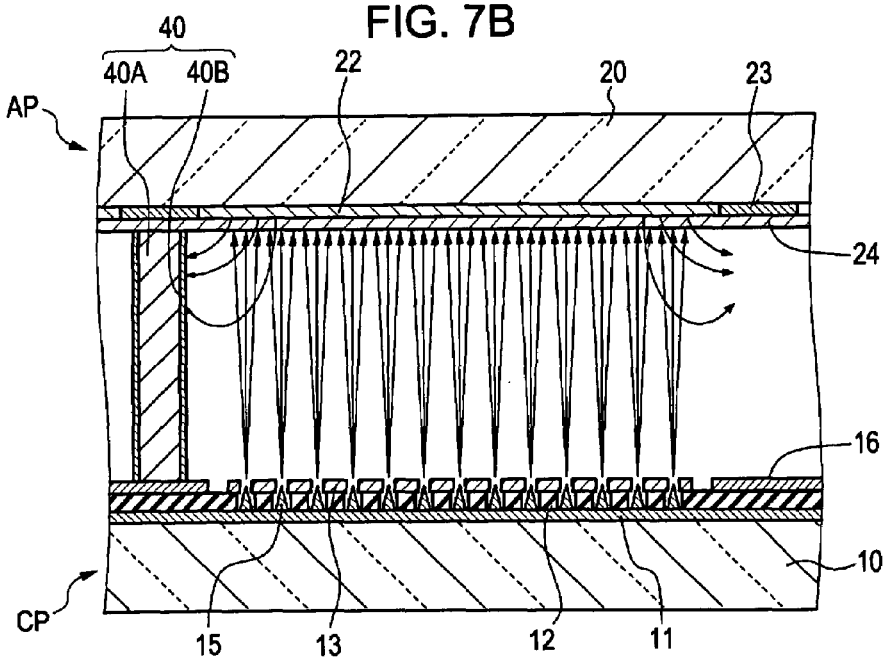
Figure 8:
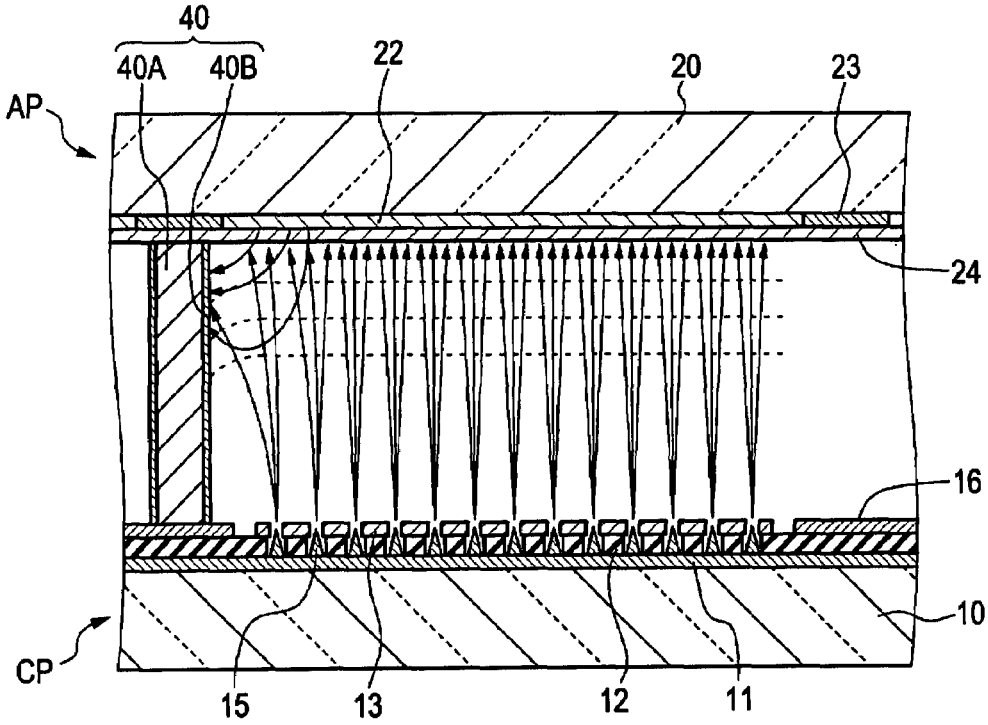
FIG. 8 is a schematic diagram for explaining that electron beam orbits are curved by the change of the electric resistance of an antistatic coating in a pixel positioned in the vicinity of the spacer.

In the display of Example, a schematic perspective exploded view of a part of a cathode panel CP and an anode panel AP when the cathode panel CP and the anode panel AP are disassembled is similar to the diagram shown in FIG. 6.

In the display of Example, a marginal portion of a cathode panel CP provided with a plurality of electron emission regions EA and a marginal portion of an anode panel AP provided with luminescent layers 22 and an anode 24 are bonded to each other, spacers 140 are disposed between the cathode panel CP and the anode panel AP, and a space sandwiched between the cathode panel CP and the anode panel AP is maintained under vacuum.

The spacer 140 is composed of a substrate of spacer 140A and an antistatic coating 140B disposed on the side surface portion of the substrate of spacer 140A. The antistatic coating 140B is formed from germanium nitride containing no transition metal. The thickness of the antistatic coating 140B is within the range of 2 nm to 20 nm, and the volume resistivity of the substrate of spacer 140A is within the range of $5\times10^6$ Ω·m to $2\times10^8$ Ω·m, more specifically is within the range of $1\times10^7$ Ω·m to $1\times10^8$ Ω·m. The spacer 140 will be described later in detail.

The structure of the display of Example will be described below, and a method for manufacturing the spacer and the display of Example will be described. Thereafter, the characteristics of the display incorporated with the spacers of Example will be described.

First, the structure of the display of Example will be described.

As shown in FIG. 1, in the cathode panel CP of Example, a cathode 11 is in the shape of a band extending in a first direction (Y direction), and a gate electrode 13 is in the shape of a band extending in a second direction (X direction) different from the first direction. Each of the cathode 11 and the gate electrode 13 is formed into the shape of a band in such a way that the directions of the projected images of the two electrodes 11 and 13 become orthogonal to each other. The region where the band-shaped cathode 11 and the band-shaped gate electrode 13 overlap each other is an electron emission region EA. A plurality of field emission elements are disposed in the electron emission region EA corresponding to one subpixel. The electron emission regions EA, each corresponding to one subpixel, are arrayed in a two-dimensional matrix in the effective region of the cathode panel CP.

An interlayer insulating layer 16 is disposed on an insulating layer 12 and the gate electrode 13, and a focusing electrode 17 formed from aluminum having an thickness of 0.4 μm is disposed thereon on the basis of a DC sputtering method. The focusing electrode 17 may exert a common converging effect on the plurality of field emission elements. A third opening 14C communicating with a first opening 14A is disposed in the interlayer insulating layer 16. A penetration hole (not shown in the drawing) for evacuation is disposed in an invalid region of the cathode panel CP. An exhaust tube (not shown in the drawing), which may be referred to as a tip tube and which is sealed and cut after evacuation, is attached to the penetration hole.

In Example, the field emission element constituting the electron emission region EA is composed of a Spindt type electron emission element. The Spindt type electron emission element is composed of:

(a) the cathode 11 disposed on a support 10, (b) the insulating layer 12 disposed on the support 10 and the cathode 11, (c) the gate electrode 13 disposed on the insulating layer 12, (d) an opening 14 disposed in the gate electrode 13 and the insulating layer 12 (the first opening 14A disposed in the gate electrode 13 and an second opening 14B disposed in the insulating layer 12), and (e) a conical electron emission portion 15 disposed on the cathode 11 positioned at the bottom of the opening 14.

In Example, the anode panel AP is composed of a substrate 20, luminescent layers 22 disposed on the substrate 20, and an anode 24 covering the luminescent layers 22. More specifically, the anode panel AP is provided with the substrate 20, luminescent layers 22 (red-emitting luminescent layers 22R, green-emitting luminescent layers 22G, and blue-emitting luminescent layers 22B), which are disposed on the substrate 20 between a partition wall 21 and another partition wall 21 disposed on the substrate 20 and which is composed of many luminescent particles, and the anode 24 disposed on the luminescent layers 22. The anode 24 is formed from aluminum (Al) having an thickness of about 0.3 μm, and is a in the shape of a thin single sheet covering the effective region. The anode 24 is disposed in such a way as to cover the partition walls 21 and the luminescent layers 22. A light absorbing layer (black matrix) 23 is disposed between a luminescent layer 22 and another luminescent layer 22 and between the partition wall 21 and the substrate 20 in order to prevent an occurrence of color blurring of a display image or an occurrence of optical crosstalk. The space sandwiched between the cathode panel CP and the anode panel AP is allowed to become under vacuum (pressure: for example, $10^{-3}$ Pa or less).

Figure 2:
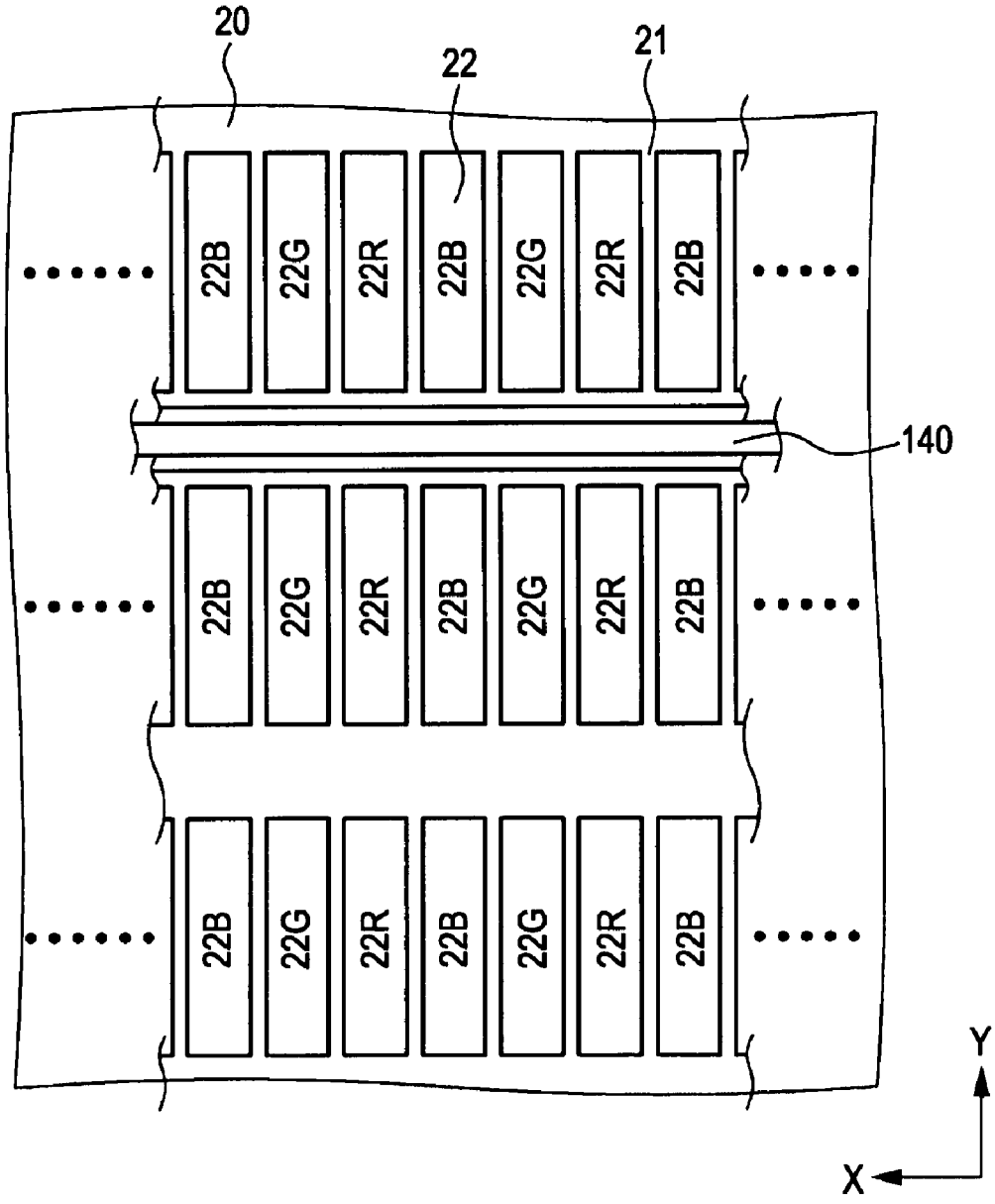
FIG. 2 is a schematic plan view for explaining the arrangement state of partition walls, spacers, and luminescent layers in a flat-panel type display of Example.

FIG. 2 is a schematic plan view for explaining the arrangement state of partition walls 21, spacers 140, and luminescent layers 22 in the display of Example. In FIG. 2, the anode 24 is omitted. The two-dimensional shape of the partition walls 21 is of a lattice type (a double crossed type), that is, the two-dimensional shape is, for example, a shape surrounding the nearly rectangular luminescent layer 22 corresponding to one subpixel. A part of the partition walls also function as spacer holding portions 25 for holding the spacers 140.

Each subpixel is composed of an electron emission region EA on the cathode panel side and a luminescent layer 22 on the anode panel side facing a group of the field emission elements. The pixels of the order of a few hundreds of thousands to a few millions, for example, are arrayed in the effective region. In the display for performing color display, each pixel is composed of a set of one red-emitting subpixel, one green-emitting subpixel, and one blue-emitting subpixel.

In Example, the cathode 11 is connected to a cathode control circuit 31, the gate electrode 13 is connected to a gate electrode control circuit 32, the focusing electrode 17 is connected to a focusing electrode control circuit (not shown in the drawing), and the anode 24 is connected to an anode control circuit 33. These control circuits may be composed of known circuits. In an actual operation of the display, the anode voltage $V_A$ applied from the anode control circuit 33 to the anode 24 is usually constant, and may be set at, for example, 5 kilovolts to 15 kilovolts, and specifically, for example, at 9 kilovolts (for example, $d_0$=2.0 mm). On the other hand, in the actual operation of the display, with respect to the voltage $V_C$ applied to the cathode 11 and the voltage $V_G$ applied to the gate electrode 13, any one of (1) a system in which the voltage $V_C$ applied to the cathode 11 is made constant, and the voltage $V_G$ applied to the gate electrode 13 is varied, (2) a system in which the voltage $V_C$ applied to the cathode 11 is varied, and the voltage $V_G$ applied to the gate electrode 13 is made constant, and (3) a system in which the voltage $V_C$ applied to the cathode 11 is varied, and the voltage $V_G$ applied to the gate electrode 13 is also varied is adopted.

In the actual operation of the display, a relatively negative voltage ($V_C$) is applied to the cathode 11 from the cathode control circuit 31, a relatively positive voltage ($V_G$) is applied to the gate electrode 13 from the gate electrode control circuit 32, 0 volts, for example, is applied to the focusing electrode 17 from the focusing electrode control circuit, and a positive voltage (anode voltage $V_A$) further higher than the voltage of the gate electrode 13 is applied to the anode 24 from the anode control circuit 33. In the case where display is performed in the above-described display, for example, a scanning signal is input into the cathode 11 from the cathode control circuit 31, and a video signal is input into the gate electrode 13 from the gate electrode control circuit 32. Alternatively, a video signal may be input into the cathode 11 from the cathode control circuit 31, and a scanning signal may be input into the gate electrode 13 from the gate electrode control circuit 32. Electrons are emitted from the electron emission portion 15 on the basis of the quantum tunnel effect by an electric field generated when a voltage is applied between the cathode 11 and the gate electrode 13, and the electrons are attracted to the anode 24 and pass through the anode 24, so as to collide with the luminescent layer 22. As a result, the luminescent layer 22 is excited and emits light, so that a desired image is obtained. That is, the operation of this display is basically controlled by the voltage $V_G$ applied to the gate electrode 13 and the voltage $V_C$ applied to the cathode 11.

The structure of the display of Example has been described above. The method for manufacturing the spacer 140 and the display of Example will be described below.

The spacer 140 of Example is composed of a substrate of spacer 140A and an antistatic coating 140B disposed on the side surface portion of the substrate of spacer 140A. The antistatic coating 140B is formed from germanium nitride containing no transition metal. The thickness of the antistatic coating 140B is within the range of 2 nm to 20 nm, and the volume resistivity of the substrate of spacer 140A is within the range of $5\times10^6$ Ω·m to $2\times10^8$ Ω·m, and more specifically is within the range of $1\times10^7$ Ω·m to $1\times10^8$ Ω·m.

Figure 3:
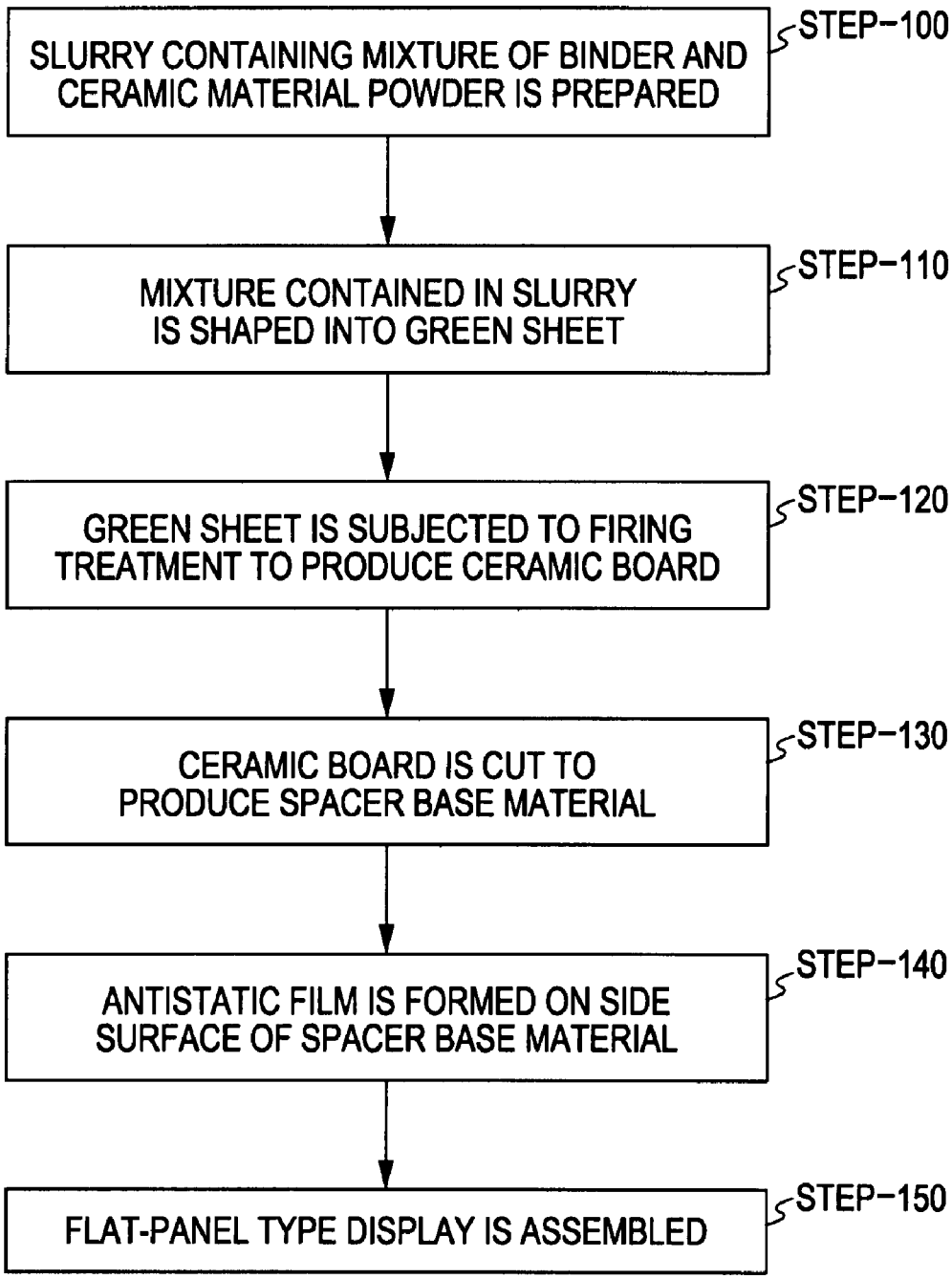
FIG. 3 is a production process diagram of a spacer and a flat-panel type display (cold-cathode field electron emission display) of Example.

The method for manufacturing the spacer of Example and the method for manufacturing the flat-panel type display of Example will be described below with reference to FIG. 3. FIG. 3 is a production process diagram of the spacer and the flat-panel type display of Example.

Step-100

A green sheet slurry is prepared, in which a ceramic powder and a metal oxide powder serving as an electrical conductivity-imparting material are used as the dispersoid and a binder composed of an organic material, e.g., an acrylic emulsion and polyvinyl alcohol (PVA), is added (refer to Step-100 shown in FIG. 3). In Example, 4 types of slurry were used where the ratio of the ceramic material and the metal oxide were changed. The compositions of the ceramic material and the metal oxide constituting the slurry in Example are shown in Table 1. These materials are mixed with a dispersion medium composed of, for example, water containing a surfactant, so as to prepare a slurry.

Step-110

A green sheet is produced from the green sheet slurry (refer to Step-110 shown in FIG. 3). In Example, the prepared green sheet slurry was made into a sheet having a thickness of about 125 μm by a blade coating method, and the green sheet was produced by being dried adequately at 100° C., although not limited to this.

Step-120

The green sheet is subjected to a firing treatment, so as to produce a tabular ceramic material (refer to Step-120 shown in FIG. 3). The green sheet shrinks by about 20% through the firing treatment. In Example, the green sheet was placed on a molybdenum setter, and was fired at 1,650° C. for about 1 hour in an atmosphere in which nitrogen:hydrogen=1:3, so as to produce a tabular ceramic material, although not limited to this.

Step-130

The tabular ceramic material is cut so as to produce a substrate of spacer 140A (refer to Step-130 shown in FIG. 3). In Example, the dimension of the substrate of spacer 140A was 150 mm in a longitudinal direction (the X direction shown in FIG. 1), 100 μm in a thickness direction (the Y direction shown in FIG. 1), and 2 mm in a height direction (the Z direction shown in FIG. 1), although not limited to them. The volume resistivity of the substrate of spacer 140A is shown in Table 1.

Step-140

An antistatic coating 140B having a thickness of 2 nm to 20 nm is formed on the side surface portion of the substrate of spacer 140B (refer to Step-130 shown in FIG. 3). Specifically, the antistatic coating 140B is formed by a sputtering method under the condition exemplified in the following Table 2. In Example, 16 types of spacers in total based on the combinations of (4 types of thickness of the antistatic coating)×(4 types of slurry) were prepared. In Table 1, for example, with respect to the wording "Example 1A", the number "1" represents the specification of the antistatic coating and the letter "A" represents the type of the slurry. The same goes for Comparative examples in Table 3 to Table 5, as described later. It is preferable that the volume resistivities of the spacers are equalized to some extent in order to compare changes over time appropriately. Therefore, the firing conditions of the individual spacers were adjusted in such a way as to allow the volume resistivities of the spacers to fall within nearly the same range.

The spacer 140 of Example composed of the substrate of spacer 140A and the antistatic coating 140B may be produced by the above-described Step-100 to Step-140.

For purposes of comparison, the spacers of Comparative examples shown in Table 3 to Table 5 were produced as in the above-described Step-100 to Step-140. With respect to the spacers of Comparative examples shown in Table 3 and Table 4, the antistatic coatings were formed under the conditions exemplified in the following Table 2. With respect to the spacers of Comparative examples shown in Table 5, the antistatic coatings were formed under the conditions exemplified in the following Table 6. The 4 types of "composition of powder contained in slurry" shown in Table 1 and Table 3 to Table 5 are common to Table 1 and Table 3 to Table 5. In Comparative examples shown in Table 4, substrate of spacers having a volume resistivity of $2\times10^8$ Ω·m or more were particularly selected among the substrate of spacers produced through Step-100 to Step-130 and the antistatic coatings were formed.

Step-150

Subsequently, a flat-panel type display is assembled. Specifically, the anode panel AP and the cathode panel CP are arranged in such a way that the luminescent layers 22 and the electron emission regions EA are opposed to each other with the spacer 140 therebetween. The marginal portions of the anode panel AP and the cathode panel CP (more specifically, the support 10 and the substrate 20) are bonded to each other with the bonding component 26 therebetween. For example, in the case where the bonding component is composed of a frame body and a bonding material layer, frit glass is applied to a bonding section of the frame body constituting the bonding component and the anode panel AP and a bonding section of the frame body and the cathode panel CP, so as to form a bonding material layer constituting the bonding component, the frit glass is dried by prefiring, the anode panel AP, the cathode panel CP, and the frame body are bonded to each other and, thereafter, formal firing is performed at about 450° C. for 10 to 30 minutes. It is desired that the formal firing is performed in an inert gas atmosphere in order to prevent oxidation and the like due to the firing. The space surrounded by the anode panel AP, the cathode panel CP, and the bonding component 26 is evacuated through a penetration hole (not shown in the drawing) and a tip tube (not shown in the drawing). When the pressure of the space reaches about $10^{-4}$ Pa, the tip tube is sealed and cut by heat-fusion or press-contact. In this manner, the space surrounded by the anode panel AP, the cathode panel CP, and the bonding component 26 is allowed to become under vacuum. Subsequently, the required wiring to external circuits is performed, so that the flat-panel type display of Example may be completed.

The displays incorporated with the spacers of Example 1A to Example 4D were used, and changes in brightness over time of a pixel in the vicinity of the spacer 140 were measured. Specifically, the white was displayed on all over the display region, and the brightness barycenter of the pixel (in Example, one subpixel) in the vicinity of the spacer 140 was measured by a method as described below. The voltage applied to the anode panel AP (more specifically, the anode 24) is set at about 10 kV, and the driving condition of the display is set in such a way that the electric power calculated from the above-described voltage and the effective value of the amount of current passing the anode becomes about 20 W. The display region of the flat-panel type display is about 40 cm×30 cm. Similar measurements were performed by using the displays incorporated with the spacers of Comparative example 1A to Comparative example 6D shown in Table 3 to Table 5.

Figure 4A:
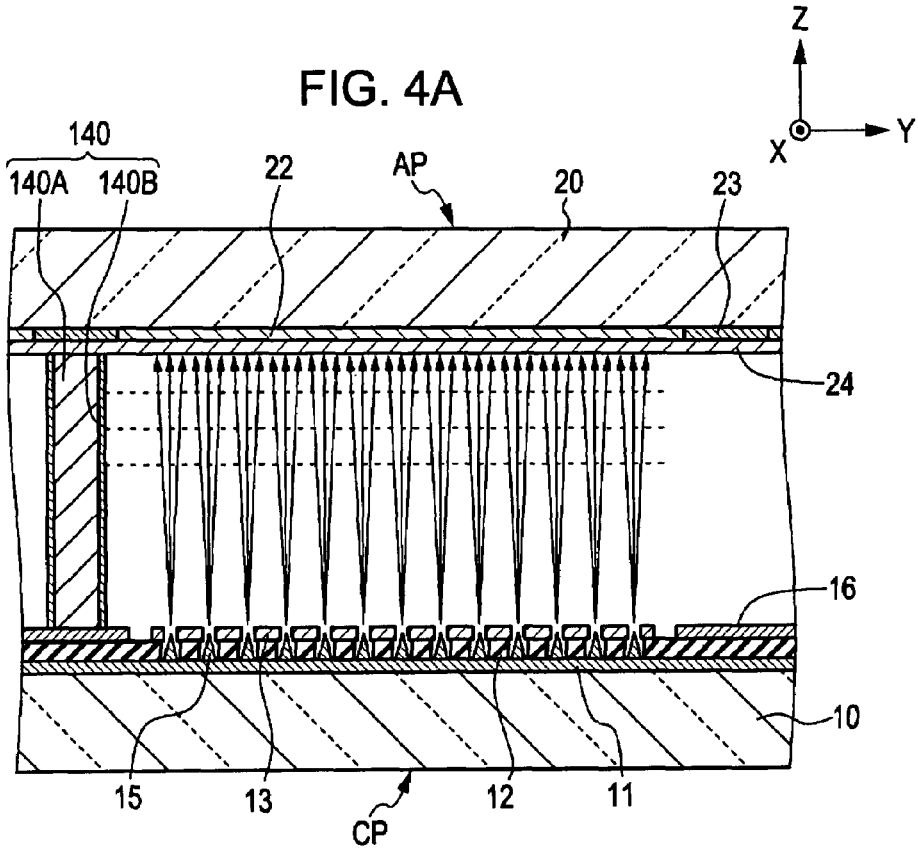
FIG. 4A is a diagram schematically showing the orbits of electron beams in a pixel (one subpixel in Example) positioned in the vicinity of a spacer.
Figure 4B:
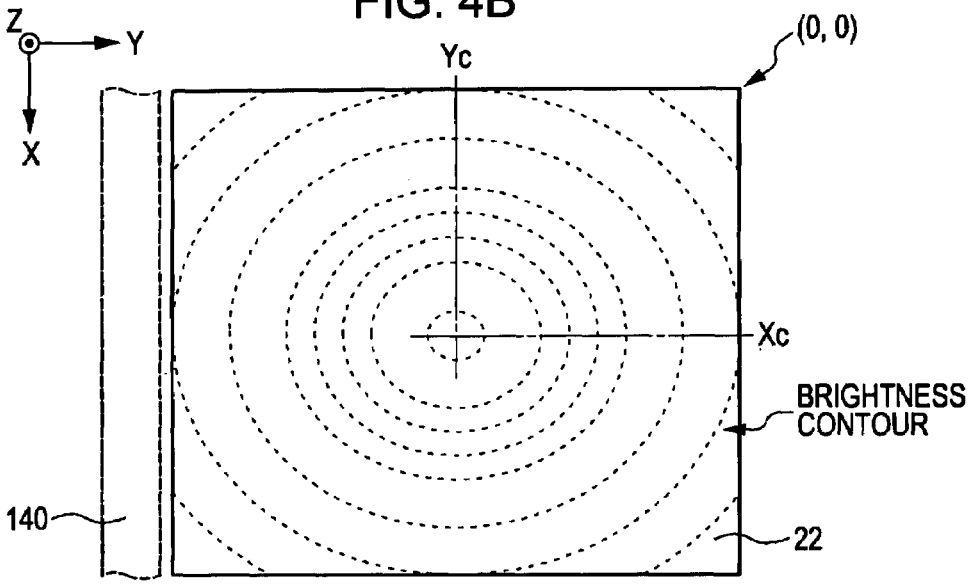
FIG. 4B is a diagram schematically showing the brightness distribution of a luminescent layer in the state shown in FIG. 4A.
Figure 5:
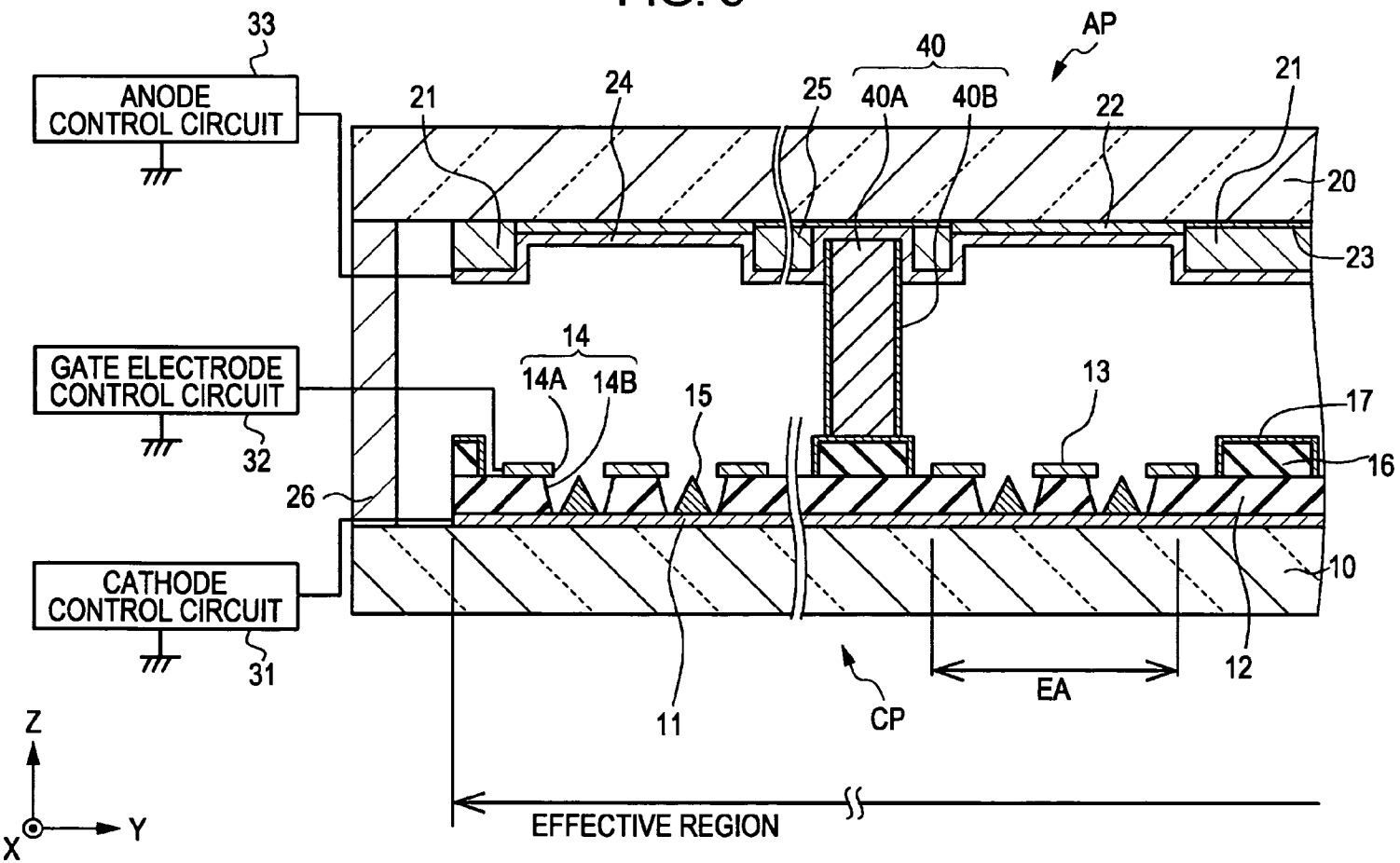
FIG. 5 is a conceptual partial end view of a known cold-cathode field electron emission display having a Spindt type field emission element.

A method for determining the brightness barycenter will be described below with reference to FIGS. 4A and 4B. FIG. 4A is a diagram schematically showing the orbits of electron beams in a pixel (in Example, one subpixel) positioned in the vicinity of the spacer 140. FIG. 4B is a diagram schematically showing the brightness distribution of a luminescent layer 22 in the state shown in FIG. 4A. Usually, the brightness of the perimeter of the luminescent layer 22 tends to become lower relative to the brightness of the central portion of the luminescent layer 22. The broken line shown in FIG. 4B schematically shows contours of brightness in the luminescent layer 22. As shown in FIG. 4B, when the upper right corner of the luminescent layer 22 is assumed to be an origin (O,O) and the brightness at the point $(x_i,y_j)$ on the luminescent layer 22 is represented by $L(x_i,y_j)$, the coordinates $(X_C,Y_C)$ of the brightness barycenter can be determined by the following Formula (1) and Formula (2).

$$X_c = \frac{\sum_i \sum_j x_i L(x_i, y_j)}{\sum_i \sum_j L(x_i, y_j)} \quad \text{Formula (1)}$$

$$Y_c = \frac{\sum_i \sum_j y_i L(x_i, y_j)}{\sum_i \sum_j L(x_i, y_j)} \quad \text{Formula (2)}$$

With respect to the pixel to be measured, the brightness barycenter just after the operation of the display (hereafter may be referred to as a brightness barycenter at the initial stage) and the brightness barycenter after a lapse of a predetermined time in the operation state (hereafter may be referred to as a brightness barycenter after changes over time) were measured. Specifically, with respect to the pixel to be measured, the brightness distribution in the inside thereof was measured with a CCD camera or the like just after the display was lit up. The brightness $L(x_i,y_j)$ was determined by using the measurement results. The coordinates $(X_{CS},Y_{CS})$ of the brightness barycenter at the initial stage was calculated by using the resulting brightness $L(x_i,y_j)$. After a lapse of a predetermined time while the display was in the operation state, the coordinates $(X_{CT},Y_{CT})$ of the brightness barycenter after changes over time was calculated in a manner similar to that described above.

The amount of displacement of the brightness barycenter is determined by using the coordinates $(X_{CS},Y_{CS})$ of the brightness barycenter at the initial stage and the coordinates $(X_{CT},Y_{CT})$ of the brightness barycenter after changes over time. Specifically, the distance between the two brightness barycenters is determined by calculation. The above-described operations were performed with respect to the display of Example, and an operation time required for the brightness barycenter of the pixel positioned in the vicinity of the spacer to move 5 μm was calculated. The results are shown in Table 1 and Table 3 to Table 5. When the operation time reached $3.5\times10^4$ hours (35,000 hours) or more, the measurement was terminated at that point in time.

As shown in Table 1, with respect to the spacers of Example 1A to Example 4D, the operation times required for the brightness barycenter of the pixel positioned in the vicinity of the spacer to move 5 μm are $3.5\times10^4$ hours or more.

On the other hand, as shown in Table 3, with respect to the spacer of Comparative example 1A, the thickness of the antistatic coating was less than 2 nm, the function of the antistatic coating was inadequate, and changes in brightness resulting from charging of the spacer were observed visually from just after the operation of the display. With respect to the spacers of Comparative example 2B and Comparative example 2C, the thickness of the antistatic coating was a thick 25 to 30 nm, and changes in brightness resulting from charging of the spacers were observed visually from just after the operation of the display. The measurements of the changes over time of these spacers were canceled.

As shown in Table 4, with respect to the spacers of Comparative example 4A to Comparative example 5D, the volume resistivity of the substrate of spacer exceeded $2\times10^8$ Ω·m, hitches occurred in the flow of the electrical charge due to charging to the anode panel side or the cathode panel side, and changes in brightness resulting from charging of the spacers were observed visually from just after the operation of the display. The measurements of the changes over time of these spacers were also canceled.

As shown in Table 5, with respect to the spacers of Comparative example 6A to Comparative example 6D, the operation times required for the brightness barycenter of the pixel positioned in the vicinity of the spacer to move 5 μm are, at best, about $2\times10^4$ hours.

According to the above-described measurement results, the antistatic coating is formed from germanium nitride containing no transition metal, the thickness of the antistatic coating is specified to be within the range of 2 nm to 20 nm, the volume resistivity of the substrate of spacer is specified to be within the range of $5\times10^6$ Ω·m to $2\times10^8$ Ω·m, more specifically within the range of $1\times10^7$ Ω·m to $1\times10^8$ Ω·m and, thereby, variations in electric resistance of the antistatic coating may be reduced, and relative changes in brightness of pixels along the spacer may be reduced.

TABLE 1

| | Composition of powder contained in slurry | | | Specification of antistatic coating | | |
|---|---|---|---|---|---|---|
| | Ceramic material (percent by volume) (Note 1) | Metal oxide (percent by volume) (Note 1) | Volume resistivity of substrate of spacer (Ω · m) | Material | Thickness | Operation time required for brightness barycenter to move 5 μm |
| Example 1A | alumina (98%)/titania (2%)/— | — | $1 \times 10^7$ to $10^8$ Ω · m | germanium nitride | 2 nm | $3.5 \times 10^4$ hours or more |
| Example 1B | alumina (93%)/titania (2%)/ magnesium oxide (5%) | — | $1 \times 10^7$ to $10^8$ Ω · m | germanium nitride | 2 nm | $3.5 \times 10^4$ hours or more |
| Example 1C | alumina (88%)/titania (2%)/ zirconium oxide (10%) | — | $1 \times 10^7$ to $10^8$ Ω · m | germanium nitride | 2 nm | $3.5 \times 10^4$ hours or more |
| Example 1D | alumina (88%)/titania (2%)/— | molybdenum trioxide (10%) | $1 \times 10^7$ to $10^8$ Ω · m | germanium nitride | 2 nm | $3.5 \times 10^4$ hours or more |
| Example 2A | alumina (98%)/titania (2%)/— | — | $1 \times 10^7$ to $10^8$ Ω · m | germanium nitride | 5 nm | $3.5 \times 10^4$ hours or more |
| Example 2B | alumina (93%)/titania (2%)/ magnesium oxide (5%) | — | $1 \times 10^7$ to $10^8$ Ω · m | germanium nitride | 5 nm | $3.5 \times 10^4$ hours or more |
| Example 2C | alumina (88%)/titania (2%)/ zirconium oxide (10%) | — | $1 \times 10^7$ to $10^8$ Ω · m | germanium nitride | 5 nm | $3.5 \times 10^4$ hours or more |
| Example 2D | alumina (88%)/titania (2%)/— | molybdenum trioxide (10%) | $1 \times 10^7$ to $10^8$ Ω · m | germanium nitride | 5 nm | $3.5 \times 10^4$ hours or more |
| Example 3A | alumina (98%)/titania (2%)/— | — | $1 \times 10^7$ to $10^8$ Ω · m | germanium nitride | 10 nm | $3.5 \times 10^4$ hours or more |
| Example 3B | alumina (93%)/titania (2%)/ magnesium oxide (5%) | — | $1 \times 10^7$ to $10^8$ Ω · m | germanium nitride | 10 nm | $3.5 \times 10^4$ hours or more |
| Example 3C | alumina (88%)/titania (2%)/ zirconium oxide (10%) | — | $1 \times 10^7$ to $10^8$ Ω · m | germanium nitride | 10 nm | $3.5 \times 10^4$ hours or more |
| Example 3D | alumina (88%)/titania (2%)/— | molybdenum trioxide (10%) | $1 \times 10^7$ to $10^8$ Ω · m | germanium nitride | 10 nm | $3.5 \times 10^4$ hours or more |
| Example 4A | alumina (98%)/titania (2%)/— | — | $1 \times 10^7$ to $10^8$ Ω · m | germanium nitride | 20 nm | $3.5 \times 10^4$ hours or more |
| Example 4B | alumina (93%)/titania (2%)/ magnesium oxide (5%) | — | $1 \times 10^7$ to $10^8$ Ω · m | germanium nitride | 20 nm | $3.5 \times 10^4$ hours or more |
| Example 4C | alumina (88%)/titania (2%)/ zirconium oxide (10%) | — | $1 \times 10^7$ to $10^8$ Ω · m | germanium nitride | 20 nm | $3.5 \times 10^4$ hours or more |
| Example 4D | alumina (88%)/titania (2%)/— | molybdenum trioxide (10%) | $1 \times 10^7$ to $10^8$ Ω · m | germanium nitride | 20 nm | $3.5 \times 10^4$ hours or more |

(Note 1): A number in parentheses of "Composition of powder contained in slurry" is a value where the total volume of the ceramic material and the metal oxide contained in the slurry is assumed to be 100%.
(Note 2): Changes in brightness corresponding to the spacer resulting from charging of the spacer is observed visually from just after the operation of the display.

TABLE 2

| Film formation condition of antistatic coating by sputtering method | |
|---|---|
| Target: | Target formed from germanium containing no transition metal |
| Substrate of spacer temperature: | 25° C. |
| Film formation speed: | 0.1 nm/sec |

TABLE 2-continued

| Film formation condition of antistatic coating by sputtering method | |
|---|---|
| Pressure: | 0.5 Pa |
| Process gas: | Mixed gas of argon and nitrogen (flow rate ratio of argon to nitrogen 1:1) |
| Sputtering method: | RF sputtering |

TABLE 3

| | Composition of powder contained in slurry | | | Specification of antistatic coating | | |
|---|---|---|---|---|---|---|
| | Ceramic material (percent by volume) (Note 1) | Metal oxide (percent by volume) (Note 1) | Volume resistivity of substrate of spacer (Ω · m) | Material | Thickness | Operation time required for brightness barycenter to move 5 μm |
| Comparative example 1A | alumina (98%)/titania (2%)/— | — | $1 \times 10^7$ to $10^8$ Ω · m | germanium nitride | 1 nm | Visibility was poor at initial stage (Note 2) |
| Comparative example 1B | alumina (93%)/titania (2%)/ magnesium oxide (5%) | — | $1 \times 10^7$ to $10^8$ Ω · m | germanium nitride | 1 nm | |
| Comparative example 1C | alumina (88%)/titania (2%)/ zirconium oxide (10%) | — | $1 \times 10^7$ to $10^8$ Ω · m | germanium nitride | 1 nm | |
| Comparative example 1D | alumina (88%)/titania (2%)/— | molybdenum trioxide (10%) | $1 \times 10^7$ to $10^8$ Ω · m | germanium nitride | 1 nm | |
| Comparative example 2A | alumina (98%)/titania (2%)/— | — | $1 \times 10^7$ to $10^8$ Ω · m | germanium nitride | 25 nm | Visibility was poor at initial stage (Note 2) |
| Comparative example 2B | alumina (93%)/titania (2%)/ | — | $1 \times 10^7$ to $10^8$ Ω · m | germanium nitride | 25 nm | |

TABLE 3-continued

| | Composition of powder contained in slurry | | | Specification of antistatic coating | | Operation time required for brightness barycenter |
|---|---|---|---|---|---|---|
| | Ceramic material (percent by volume) (Note 1) | Metal oxide (percent by volume) (Note 1) | Volume resistivity of substrate of spacer (Ω · m) | Material | Thickness | to move 5 μm |
| Comparative example 2C | alumina (88%)/titania (2%)/ zirconium oxide (10%) | — | $1 \times 10^7$ to $10^8$ Ω · m | germanium nitride | 25 nm | |
| Comparative example 2D | alumina (88%)/titania (2%)/— | molybdenum trioxide (10%) | $1 \times 10^7$ to $10^8$ Ω · m | germanium nitride | 25 nm | |
| Comparative example 3A | alumina (98%)/titania (2%)/— | — | $1 \times 10^7$ to $10^8$ Ω · m | germanium nitride | 30 nm | Visibility was poor at initial stage (Note 2) |
| Comparative example 3B | alumina (93%)/titania (2%)/ magnesium oxide (5%) | — | $1 \times 10^7$ to $10^8$ Ω · m | germanium nitride | 30 nm | |
| Comparative example 3C | alumina (88%)/titania (2%)/ zirconium oxide (10%) | — | $1 \times 10^7$ to $10^8$ Ω · m | germanium nitride | 30 nm | |
| Comparative example 3D | alumina (88%)/titania (2%)/— | molybdenum trioxide (10%) | $1 \times 10^7$ to $10^8$ Ω · m | germanium nitride | 30 nm | |

(Note 1): A number in parentheses of "Composition of powder contained in slurry" is a value where the total volume of the ceramic material and the metal oxide contained in the slurry is assumed to be 100%.
(Note 2): Changes in brightness corresponding to the spacer resulting from charging of the spacer is observed visually from just after the operation of the display.

TABLE 4

| | Composition of powder contained in slurry | | | Specification of antistatic coating | | Operation time required for brightness barycenter |
|---|---|---|---|---|---|---|
| | Ceramic material (percent by volume) (Note 1) | Metal oxide (percent by volume) (Note 1) | Volume resistivity of substrate of spacer (Ω · m) | Material | Thickness | to move 5 μm |
| Comparative example 4A | alumina (98%)/titania (2%)/— | — | $2 \times 10^8$ Ω · m or more | germanium nitride | 2 nm | Visibility was poor at initial stage (Note 2) |
| Comparative example 4B | alumina (93%)/titania (2%)/ magnesium oxide (5%) | — | $2 \times 10^8$ Ω · m or more | germanium nitride | 2 nm | |
| Comparative example 4C | alumina (88%)/titania (2%)/ zirconium oxide (10%) | — | $2 \times 10^8$ Ω · m or more | germanium nitride | 2 nm | |
| Comparative example 4D | alumina (88%)/titania (2%)/— | molybdenum trioxide (10%) | $2 \times 10^8$ Ω · m or more | germanium nitride | 2 nm | |
| Comparative example 5A | alumina (98%)/titania (2%)/— | — | $2 \times 10^8$ Ω · m or more | germania nitride | 5 nm | Visibility was poor at initial stage (Note 2) |
| Comparative example 5B | alumina (93%)/titania (2%)/ magnesium oxide (5%) | — | $2 \times 10^8$ Ω · m or more | germanium nitride | 5 nm | |
| Comparative example 5C | alumina (88%)/titania (2%)/ zirconium oxide (10%) | — | $2 \times 10^8$ Ω · m or more | germanium nitride | 5 nm | |
| Comparative example 5D | alumina (88%)/titania (2%)/— | molybdenum trioxide (10%) | $2 \times 10^8$ Ω · m or more | germanium nitride | 5 nm | |

(Note 1): A number in parentheses of "Composition of powder contained in slurry" is a value where the total volume of the ceramic material and the metal oxide contained in the slurry is assumed to be 100%.
(Note 2): Changes in brightness corresponding to the spacer resulting from charging of the spacer is observed visually from just after the operation of the display.

TABLE 5

| | Composition of powder contained in slurry | | | Specification of antistatic coating | | Operation time required for brightness barycenter |
|---|---|---|---|---|---|---|
| | Ceramic material (percent by volume) (Note 1) | Metal oxide (percent by volume) (Note 1) | Volume resistivity of substrate of spacer (Ω · m) | Material | Thickness | to move 5 μm |
| Comparative example 6A | alumina (98%)/titania (2%)/— | — | $1 \times 10^7$ to $10^8$ Ω · m | chromium oxide | 4 nm | $1.9 \times 10^4$ hours |
| Comparative example 6B | alumina (93%)/titania (2%)/ magnesium oxide (5%) | — | $1 \times 10^7$ to $10^8$ Ω · m | chromium oxide | 4 nm | $2.0 \times 10^4$ hours |
| Comparative example 6C | alumina (88%)/titania (2%)/ zirconium oxide (10%) | — | $1 \times 10^7$ to $10^8$ Ω · m | chromium oxide | 4 nm | $2.2 \times 10^4$ hours |

TABLE 5-continued

| | Composition of powder contained in slurry | | | | | Operation time required |
|---|---|---|---|---|---|---|
| | Ceramic material (percent by volume) (Note 1) | Metal oxide (percent by volume) (Note 1) | Volume resistivity of substrate of spacer (Ω · m) | Specification of antistatic coating | | for brightness barycenter to move 5 μm |
| | | | | Material | Thickness | |
| Comparative example 6D | alumina (88%)/titania (2%)/— | molybdenum trioxide (10%) | $1 \times 10^7$ to $10^8$ Ω · m | chromium oxide | 4 nm | $1.8 \times 10^4$ hours |

(Note 1): A number in parentheses of "Composition of powder contained in slurry" is a value where the total volume of the ceramic material and the metal oxide contained in the slurry is assumed to be 100%.

TABLE 6

| Film formation condition of antistatic coating by sputtering method | |
|---|---|
| Target: | Target formed from chromium oxide |
| Substrate of spacer temperature: | 25° C. |
| Film formation speed: | 0.2 nm/sec |
| Pressure: | 0.5 Pa |
| Process gas: | Argon |
| Sputtering method: | RF sputtering |

The present invention has been described with reference to preferred examples. However, the present invention is not limited to these examples. The configuration and the structure of the flat-panel type display, the cathode panel, the anode panel, the cold-cathode field electron emission display, and the cold-cathode field electron emission element described in Example are no more than an example, and may be changed appropriately. Likewise, the methods for manufacturing the cathode panel, the anode panel, the cold-cathode field electron emission display, and the cold-cathode field electron emission element are no more than an example, and may be changed appropriately. Furthermore, various materials used in the production of the cathode panel and the anode panel are also no more than an example, and may be changed appropriately. With respect to the display, merely the color display has been described as an example. However, monochromatic display may be adopted.

With respect to the field emission element, merely the form, in which one electron emission portion corresponds to one opening, has been described. However, a form in which a plurality of field emission elements correspond to one opening or a form in which one electron emission portion corresponds to a plurality of openings may be adopted depending on the structure of the field emission element. Alternatively, a plurality of first openings may be disposed in the gate electrode, a plurality of second openings communicating with the above-described plurality of first openings may be disposed in the insulating layer, so as to dispose at least one electron emission portion.

The electron emission source may be composed of an element, commonly called surface-conduction type electron emission element. In this surface-conduction type electron emission element, a pair of electrodes, which is formed from an electrically conductive material, e.g., tin oxide ($SnO_2$), gold (Au), indium oxide ($In_2O_3$)/tin oxide ($SnO_2$), carbon, or palladium oxide (PdO) and which have a very small area, are disposed in a matrix with a predetermined gap therebetween on a support formed from, for example, glass. A carbon thin film is disposed on each of the electrodes. In the configuration, a row direction wiring is connected to one electrode of the pair of electrodes, and a column direction wiring is connected to the other electrode of the pair of electrodes. When a voltage is applied to the pair of electrodes, an electric field is applied to the carbon thin films opposed to each other with a gap therebetween, and electrons are emitted from the carbon thin film. The resulting electrons are allowed to collide with a luminescent layer on a second panel and, thereby, the luminescent layer is excited to emit light, so that a desired image is obtained. Alternatively, the electron emission source may be composed of a metal/insulating film/metal type element.

It should be understood by those skilled in the art that various modifications, combinations, sub-combinations and alterations may occur depending on design requirements and other factors insofar as they are within the scope of the appended claims or the equivalents thereof.

What is claimed is:

1. A flat-panel type display, in which a marginal portion of a cathode panel provided with a plurality of electron emission regions and a marginal portion of an anode panel provided with luminescent layers and an anode are bonded to each other, spacers are disposed between the cathode panel and the anode panel, and a space sandwiched between the cathode panel and the anode panel is maintained under vacuum, the spacer comprising:

(a) a substrate of spacer; and (b) an antistatic coating disposed on the side surface portion of the substrate of spacer, wherein (A) the antistatic coating is formed from germanium nitride containing no transition metal, (B) the thickness of the antistatic coating is within the range of 2 nm to 20 nm, and (C) the volume resistivity of the substrate of spacer is within the range of $5\times10^6$ Ω·m to $2\times10^8$ Ω·m.

2. The flat-panel type display according to claim 1, wherein the antistatic coating is formed by a sputtering method in which a target formed from germanium containing no transition metal is used.

3. A spacer to be used in a flat-panel type display, in which a marginal portion of a cathode panel provided with a plurality of electron emission regions and a marginal portion of an anode panel provided with luminescent layers and an anode are bonded to each other, and a space sandwiched between the cathode panel and the anode panel is maintained under vacuum, the spacer being disposed between the cathode panel and the anode panel and comprising:

(a) a substrate of spacer; and (b) an antistatic coating disposed on the side surface portion of the substrate of spacer, wherein (A) the antistatic coating is formed from germanium nitride containing no transition metal, (B) the thickness of the antistatic coating is within the range of 2 nm to 20 nm, and (C) the volume resistivity of the substrate of spacer is within the range of $5\times10^{6}$ Ω·m to $2\times10^{8}$ Ω·m.

4. The spacer according to claim 3, wherein the antistatic coating is formed by a sputtering method in which a target formed from germanium containing no transition metal is used.

* * * * *